US011817229B2

(12) United States Patent
Moharrer

(10) Patent No.: US 11,817,229 B2
(45) Date of Patent: Nov. 14, 2023

(54) METHOD AND SYSTEM TO CONTAIN OR ENCAPSULATE RADIOACTIVE MATERIALS AND TOXIC SUBSTANCES FOR TRANSPORTATION OR CONTAINMENT

(71) Applicant: Hazprotect Pty Ltd, Port Melbourne (AU)

(72) Inventor: Mohammad Ali Sanagooy Moharrer, Hallam (AU)

( * ) Notice: Subject to any disclaimer, the term of this patent is extended or adjusted under 35 U.S.C. 154(b) by 0 days.

(21) Appl. No.: 15/766,408

(22) PCT Filed: Oct. 7, 2016

(86) PCT No.: PCT/AU2016/050944
§ 371 (c)(1),
(2) Date: Apr. 6, 2018

(87) PCT Pub. No.: WO2017/059496
PCT Pub. Date: Apr. 13, 2017

(65) Prior Publication Data

US 2018/0240559 A1 Aug. 23, 2018

(30) Foreign Application Priority Data

Oct. 9, 2015 (AU) ..... 2015904116

(51) Int. Cl.
*G21F 1/10* (2006.01)
*G21F 9/36* (2006.01)
(Continued)

(52) U.S. Cl.
CPC ..... *G21F 1/10* (2013.01); *G21F 1/12* (2013.01); *G21F 5/00* (2013.01); *G21F 5/005* (2013.01);
(Continued)

(58) Field of Classification Search
CPC ..... G21F 3/00; G21F 1/10; G21F 5/00; G21F 5/005; G21F 1/125; G21F 5/12; G21F 9/34; G21F 9/36
See application file for complete search history.

(56) References Cited

U.S. PATENT DOCUMENTS 4,021,363 A * 5/1977 Standart ..... G21F 9/307 206/524.1
4,586,624 A 5/1986 Shaw
(Continued)

FOREIGN PATENT DOCUMENTS

GB 1482780 A * 8/1977 ..... G21F 9/16
JP H0478344 5/1983
(Continued)

OTHER PUBLICATIONS

International Search Report dated Dec. 16, 2016 for International Application No. PCT/AU2016/050944.
(Continued)

*Primary Examiner* — David E Smith
*Assistant Examiner* — Hsien C Tsai

(57) ABSTRACT

A composite panel for a toxic material encapsulation system, comprising a reinforcing structure extending within and integrally formed with a non-biodegradable thermoplastic polymer.

16 Claims, 8 Drawing Sheets

(51) Int. Cl.

| | |
|---|---|
| ***G21F 5/00*** | (2006.01) |
| ***G21F 9/30*** | (2006.01) |
| ***G21F 1/12*** | (2006.01) |
| ***G21F 5/005*** | (2006.01) |
| ***G21F 5/12*** | (2006.01) |

(52) U.S. Cl.
CPC ..... *G21F 5/12* (2013.01); *G21F 9/307* (2013.01); *G21F 9/36* (2013.01)

(56) References Cited

U.S. PATENT DOCUMENTS

| | | | | |
|---|---|---|---|---|
| 5,225,114 | A * | 7/1993 | Anderson | G21F 9/22 250/506.1 |
| 5,471,065 | A | 11/1995 | Harrell et al. | |
| 5,649,323 | A | 7/1997 | Kalb et al. | |
| 5,848,111 | A * | 12/1998 | Wells | G21F 5/012 376/272 |
| 7,449,131 | B2 * | 11/2008 | Hayner | G21F 1/10 588/6 |
| 7,518,137 | B2 | 4/2009 | Okamura et al. | |
| 2002/0179860 | A1 * | 12/2002 | Smith | G21F 1/106 250/515.1 |
| 2008/0276554 | A1 | 11/2008 | Sheetz | |
| 2010/0176318 | A1 * | 7/2010 | Smith | G21F 1/125 250/519.1 |
| 2010/0284778 | A1 * | 11/2010 | Wegeler | G21F 5/008 414/800 |
| 2011/0318441 | A1 | 12/2011 | Stengrimsen | |
| 2014/0106635 | A1 | 4/2014 | Junior | |
| 2016/0012926 | A1 * | 1/2016 | Lehnert | G21F 5/012 250/506.1 |
| 2016/0180979 | A1 * | 6/2016 | Washington, II | G21F 1/10 53/473 |
| 2017/0200518 | A1 * | 7/2017 | Yang | G21F 1/106 |

FOREIGN PATENT DOCUMENTS

| | | | |
|---|---|---|---|
| JP | 2001055201 | A | 2/2001 |
| JP | 2011501162 | A | 1/2011 |
| JP | 2014102092 | A | 6/2014 |

OTHER PUBLICATIONS

Extended European Search Report dated Jul. 10, 2019 for International Application No. PCT/AU2016/050944.
First Office Action dated Oct. 14, 2020 for Japanese Patent Application No. 2018-537695 with machine translation attached.
Second Office Action dated Feb. 17, 2021 for Japanese Patent Application No. 2018-537695 with machine translation attached.

* cited by examiner

METHOD AND SYSTEM TO CONTAIN OR ENCAPSULATE RADIOACTIVE MATERIALS AND TOXIC SUBSTANCES FOR TRANSPORTATION OR CONTAINMENT

This is a National Phase Application filed under 35 U.S.C. 371 as a national stage of PCT/AU2016/050944, filed Oct. 7, 2016, an application claiming the benefit of Australian Application No. AU2015904116 filed Oct. 9, 2015, the content of each of which is hereby incorporated by reference in its entirety.

FIELD OF THE INVENTION

The present invention relates to the efficient encapsulation, containment, storage and transportation of low level radioactive and hazardous/toxic waste. More particularly, but not exclusively, the invention relates to a composition for a toxic material encapsulation system, a composite panel for a toxic material encapsulation system, an encapsulation container, a transportation system and a method of encapsulating toxic materials such as low level radiating waste.

BACKGROUND OF THE INVENTION

Radioactive and hazardous wastes come from a number of sources. With respect to radioactive waste, the majority originates from the nuclear fuel cycle and nuclear weapons reprocessing. However, other sources include medical and industrial wastes, as well as naturally occurring radioactive materials (NORM) that can be concentrated as a result of the processing or consumption of coal, oil and gas, and some minerals. For example, coal contains a small amount of radioactive uranium, barium, thorium and potassium, and residues from the oil and gas industry often contain radium and its decay products.

Materials that are known or tested to exhibit characteristics such as ignitability, reactivity, corrosivity and flammability constitute hazardous waste. Such waste is typically generated in the course of industrial and commercial applications, including dry cleaning, automotive industry, hospitals, exterminators, and photo-processing centres. Some hazardous waste generators are larger companies such as chemical manufacturers, electroplating companies, and oil refineries, whilst households also contribute to the generation of such waste.

Radioactive and hazardous wastes can be distinguished from other types of general waste because they typically cannot be disposed of by common or routine means. For example, radioactive waste cannot be disposed of in regular landfills, but must be contained and stored until the radioactive component of the waste has "cooled". Similarly, hazardous waste that cannot be recycled or processed must be disposed of in a way that prevents leaching of the waste into the environment, for example into groundwater located in proximity to landfills.

The radioactivity of all nuclear waste diminishes (cools) with time. However, certain radioactive materials require special considerations with respect to their storage, primarily due to their long decay half-life compared to other radioactive elements. For example, radioactive elements (such as plutonium-239) in "spent" fuel will remain hazardous for hundreds or thousands of years, whilst some radioisotopes remain hazardous for millions of years (such as iodine-129). Therefore, wastes containing such isotopes must be encapsulated, stored and shielded appropriately for extended periods of time. In any event, even isotopes with a relatively short half-life must be contained in a similar manner in order to prevent leaching or dispersion into the environment during the cooling period.

It is well established that uncontrolled exposure to radioactive material is harmful to biological tissue. Accordingly, in considering appropriate encapsulation and storage systems for radioactive (and hazardous) wastes, the potential for disruption of the integrity of the systems is a critical concern. For example, in situations which rely on underground storage of the waste, immobilization of the waste against dispersion by ecological forces must be taken into account. Various attempts have been made to effectively encapsulate and store such wastes. These include the sealing of wastes into metal or plastic containers followed by storage underground or in the ocean, or the incorporation of wastes into a matrix of materials (such as inorganic cements and polymers) while in their fluid or molten state, followed by solidification. However, such strategies are not efficient given that cementitious-type materials are highly susceptible to cracking due to drying and/or earth movement. Metal containers are prone to rusting and plastic containers will often lack mechanical strength to withstand the demanding condition under which such waste is typically stored.

Furthermore, the high viscosity of many molten plastics generally limits the quantity of waste which can be loaded into the plastic matrix, and often incorporation of wastes in a plastic mixture is limited by the inability of the matrix to isolate the waste from the environment. For example, matrices having more than a 30 percent loading of waste have been unsatisfactory because of leaching due to mobilisation of the waste. Furthermore, the use of matrices comprising conventional hydraulic cement and the use of other thermosetting polymer processes provide low efficiency of waste encapsulation, a requirement to cure the matrix by adding chemicals and/or increasing the temperature—steps which ultimately result in increased operating costs.

Other disadvantages of presently used waste encapsulation systems and materials include the inability of high atomic number shielding metals such as lead to block neutrons, the fact that some shielding materials produce secondary radiation when exposed to high energy radioactive particles, and that currently used radioactive shielding equipment is heavy due to the material used. Moreover, different industries encompass different types of radiation sources which emit varying levels of energy. The shielding ability of a material depends on the radiation type and energy level.

Many of the previously proposed systems for the disposal of toxic waste have been expensive and problematic to use. For example, steel drums are one example of a previously proposed system. In addition to issues with corrosion from the environment, corrosion from the waste is also a problem and the expected life of the drum often falls short of the decay period of the toxic material, particularly along the welded seam of conventional steel drums. Despite an internal surface of previous steel drums being coated, using paint for example, many hazardous/toxic substances can attack such coatings. Also, as the toxic material is spaced from walls of the drum, the entire space within the drum is typically not used and, as these containers are round, external spaces are created between adjacent drums, making inefficient use of storage space.

In some instances, waste such as nuclear waste has previously been submerged in water baths or buried underground. In addition to problems with leakage causing environmental damage, unintentional radiation exposure to people is a real and very serious problem.

Given that many toxic substances are required to be stored for long periods of time, disposal is often a very expensive proposition and given the ineffectiveness of previously proposed encapsulation systems, waste disposal facilities are typically remote and require large spaces to prevent people coming into contact with the toxic material.

In view of these any many other problems, examples of the invention seek to solve, or at least ameliorate, one or more disadvantages of previous toxic waste disposal systems or to at least provide a useful alternative. It is also desirable to provide a transportation system that can shield radiation during transportation to prevent accidental human exposure. It is also desirable to provide a system for extracting toxic materials from waste to enable separation and recycling of the material.

SUMMARY OF THE INVENTION

According to one aspect of the present invention there is provided a composite panel for a toxic material encapsulation system, comprising a reinforcing structure extending within and integrally formed with a non-biodegradable thermoplastic polymer.

In a preferred embodiment of the invention, the polymer is mixed with an additive to increase the flexibility of the panel.

According to another aspect of the present invention, there is provided a composite panel for a toxic material encapsulation system, comprising a reinforcing structure at least partially disposed within a matrix material, the matrix material being a composition including a non-biodegradable thermoplastic polymer and a wax or fat.

The composite panel can be used to manage low level radioactive waste or hazardous toxic material for the purpose of encapsulation, solidification and/or transportation.

According to a preferred embodiment of the invention, the non biodegradable thermoplastic polymer is selected from the group consisting of low density polyethylene (LDPE), polypropylene, high density polyethylene (HDPE), acrylic, polyvinyl ethylene, polyvinyl acetate, polyvinyl chloride (PVC), polystyrene, nylon, polybutadiene, and mixtures thereof. Preferably, the non biodegradable thermoplastic polymer is low density polyethylene (LDPE).

Preferably, the wax is selected from one or more of the group consisting of paraffin, beeswax, Chinese wax, lanolin, shellac wax, spermaceti, bayberry wax, candelilla wax, carnauba wax, insect wax, castor wax, esparto wax, Japan wax, jojoba oil, ouricury wax, rice bran wax, soy wax, lotus wax, ceresin wax, montan wax, ozocerite, peat waxes, microcrystalline wax, petroleum jelly, Fischer-Tropsch waxes, substituted amide waxes, cetyl palmitate, lauryl palmitate, cetostearyl stearate, polyethylene wax, C3o-45 Alkyl Methicone and C3o-45 Olefin. More preferably, the wax is paraffin.

The composition can further include a filler or reinforcing fibre. Preferably, the filler or reinforcing fibre is selected from one or more of the group consisting of dry clean or waste wood powder, glass fibre, carbon fibre, aramide fibre, silicon carbide fibre, boron fibre, alumina fibre, aromatic polyamide fibre, high elastic polyester fibre, hemp, jute or sisal.

According to a preferred embodiment of the invention, the reinforcing structure is encapsulated within and spans the extent of the panel. In other forms, the reinforcing structure extends externally on one or more sides of the panel.

Preferably, the panel further includes engagement members coupled to the reinforcing structure and extending externally of the panel to enable lifting of the panel.

Preferably, the panel is formed by applying the matrix material in liquid form to the reinforcing material in a mould.

The panel can further include a radiation shield for shielding radiation. The radiation shield can be a layer formed within the panel. In another form, the radiation shield is formed as a further layer of the panel and is in the form of a composition including a non-biodegradable thermoplastic polymer and a wax or fat.

Preferably, the panel includes at least one support extending from a surface of the panel which is internal in use for supporting a toxic material from the internal surface of the panel.

Preferably, the reinforcing material includes a plurality of tension bars, such as iron rebar used for reinforcing concrete. The reinforcing material may also be in the form of a mesh, netting or chain link. In other forms, the reinforcing material may be in the form of materials used in the art of reinforcing composite materials, such as for example, plastic rods or sheets, cellulose rods or sheets, fibre weaved rods or sheets, or carbon fibre or graphene fibre made into a rod or sheet. Numerous different reinforcing materials may be included in a single panel and panels having differently configured reinforcing materials may be combined to form a container with varying strength characteristics.

The panel can further include external reinforcement members disposed externally of the matrix material. In other forms, the external reinforcement members may be at least partially disposed within the matrix material.

The panel can be formed with hinges disposed along at least one edge to allow a plurality of panels to be coupled together. Advantageously, a plurality of panels can be efficiently transported in a "flat-pack" state ready for assembly and use at a required site. In such an example, liquid composition of the above described type may be used to seal any residual gaps in the container.

According to another aspect of the present invention there is provided a container for encapsulating toxic materials, the container being formed of a non-biodegradable thermoplastic polymer and having a reinforcing structure integrally formed within the polymer.

According to another aspect of the present invention there is provided a container for encapsulating toxic materials, comprising a reinforcing structure at least partially disposed within a matrix material, the matrix material being a composition including a non-biodegradable thermoplastic polymer and a wax or fat, wherein the container is formed by or including a plurality of panels of the above described type.

The container can further include an internal radiation shield, the shield being formed of a composition including boron or graphite, or combinations thereof, and fat. In another form, the shield further includes a non-biodegradable thermoplastic polymer and a wax. The shield may be formed within the container or as a separate part fixed to an inner or outer wall of the container, with the thickness being variable/adjustable and tailored to the application.

Advantageously, the container can be used, for example, to ship low level waste such as uranium oxide (yellow cake).

Preferably, the container is of unitary construction and sealed. In one form, the container is an open top container sealed by a sealing lid by melting the matrix material. Advantageously, the sealing lid and upper edges of the container may be heat fused together. In another form, adhesives or mechanical fixings may be used to close and seal the container.

According to a preferred embodiment, the container has at least one electrically conductive heating element disposed near an open end of the container and energisable for heating the matrix material to fuse a lid to the container. Preferably, the at least one heating element is integrally formed within the panel.

The container can further include corner protection members. Preferably, the container is rectangular so that it can be efficiently stacked in conventional shipping vehicles, such as shipping containers. In other forms, the container is cylindrical, in which case the body of the container may be formed of a single curved panel of the above described type.

The container can further comprise a gas discharge vent. Advantageously, gasses within the container can be vented to the atmosphere to prevent explosion. For example, gasses generated by bond scission or radiation chemistry inside the box can be prevented from reaching critical pressures.

The container can further include recesses formed in a lower portion thereof for engagement with a lifting vehicle. In one example, the recesses are configured to receive tines of a forklift or pallet truck so that the container may be handled by conventional material handling equipment.

Preferably, lower and upper surfaces of the container include complimentary shaped interlocking features to enable interlocking stacking of a plurality of containers. In one form, a lower surface of the container has at least one recess and the upper surface has at least one correspondingly shaped protrusion for receipt in a lower surface of a like container, to enable interlocking stacking of like containers.

According to another aspect of the present invention there is provided a transportation system, including a plurality of panels of the above described type and a plurality of containers of the above described type, wherein the panels are arranged within and line a transportation container within which the plurality of containers are disposed.

According to another aspect of the present invention, there is provided a method of encapsulating toxic materials, including the steps of:

inserting the toxic material into a container of the above described type; and sealing the container.

The method can further include the step of bringing to a molten form a composition including a non-biodegradable thermoplastic polymer and a wax or fat; combining the toxic material with the composition to form an admixture; and pouring the admixture into the container.

In one example, the non-biodegradable thermoplastic polymer is in granular or pellet form coated in the wax. The method can further include the step of compressing the admixture within the container.

The method can further include the step of covering the admixture with a further amount molten composition.

The method can further include the step of applying a lid to the container and sealing the container with a lid formed of a panel of the above described type.

Preferably, the admixture is combined in an auger so as to encapsulate the toxic waste in the composition. The waste can be in grinded form or in powder form before mixing in the auger.

The toxic material can be nuclear waste, medical waste or waste from mining or manufacturing processes. The toxic material can be extracted from a vapour distillation process.

The method can further include the step of bringing the waste to a molten or liquid form and separating the waste from the encapsulation composition. This may be completed after an appropriate time has lapsed, which will be different depending on the toxic material. Advantageously, useful materials may be extracted for further use. For example, with radiating isotopes used in nuclear medicine in hospital, instead of waiting many years for the isotope to stop radiating, with a little heat and existing technologies the useful isotope can be separated, purified and reused in the hospital, thereby reducing expenditure on expensive isotopes.

According to another aspect of the present invention there is provided a composite panel for a toxic material encapsulation system, comprising a reinforcing structure integrally formed within a non-biodegradable thermoplastic polymer.

According to another aspect of the present invention there is provided a container for encapsulating toxic materials, the container being formed of a non-biodegradable thermoplastic polymer and having a reinforcing structure integrally formed within the polymer.

Preferred embodiments of the invention can provide an inexpensive solution for the encapsulation, containment, storage and transportation of radioactive and hazardous/toxic waste. Furthermore, preferred embodiment of the invention can provide means for extraction, over time, of useful elements from waste so that they can be reused, thereby potentially provided a source of profit from materials currently being treated as waste.

In an attempt to address one or more of the aforementioned difficulties associated with storing radioactive and hazardous wastes, the inventor has developed an encapsulation composition and method for encapsulation of radioactive and/or hazardous waste.

Accordingly, there is disclosed herein an encapsulation composition for the encapsulation of radioactive and/or hazardous waste, the encapsulation composition including:

(i) waste, including radioactive and/or hazardous waste;

(ii) a non-biodegradable thermoplastic polymer; and (iii) a wax.

There is also disclosed herein a method for encapsulation of radioactive and/or hazardous waste, the method comprising melt mixing an encapsulating composition comprising non-biodegradable thermoplastic polymer and wax with the radioactive and/or hazardous waste, thereby encapsulating the waste in the encapsulating composition.

The melt mixing feature advantageously enables rapid and efficient formation of an intimate distribution of the waste within a polymer and wax blend. The melt mixed composition produced in accordance with the method, upon cooling, forms a solid integral mass of the polymer and wax blend with the radioactive and/or hazardous waste safely encapsulated therein. The polymer and wax blend provides for an encapsulation matrix that is advantageously mechanically robust and resistant to leaching of the waste out from the encapsulation matrix.

The method can further comprise depositing the so formed melt mixed encapsulated waste while molten into a container, thereby containing the encapsulated waste in the container.

There is also disclosed herein a method of encapsulation and containment of radioactive and/or hazardous waste, the method comprising:

(i) providing the radioactive and/or hazardous waste to be encapsulated and contained;

(ii) mixing the waste of step (i) with an encapsulation composition including a non-biodegradable thermoplastic polymer and a wax;

(iii) heating the waste and encapsulation composition mix of step (ii) such that the encapsulation composition is in a molten or liquid form, thereby encapsulating the waste; and (iv) depositing the mix of step (iii) into a container, thereby containing the waste.

Described herein is an encapsulation composition for the encapsulation of radioactive and/or hazardous waste, the encapsulation composition comprising:

(i) a non-biodegradable thermoplastic polymer; and (ii) a wax.

Also described herein is a composition for preventing leaching of radioactive and/or hazardous waste into the environment, the composition including:

(i) waste, including radioactive and/or hazardous waste; and (ii) an encapsulation composition including:

(a) a non-biodegradable thermoplastic polymer; and (b) a wax.

There is further described herein a system for the encapsulation and containment of radioactive and/or hazardous waste, the system including:

(i) an encapsulation composition for the encapsulation of the radioactive and/or hazardous waste, the encapsulation composition including a non-biodegradable thermoplastic polymer, and a wax; and (ii) a container for receiving the encapsulation composition.

As a result of the present invention, efficient encapsulation and containment of radioactive and/or hazardous wastes can be readily achieved. The waste is in effect stabilised by binding with, and being held by, the constituents of the encapsulation composition, which provides for a stable monolithic waste form that is resistant to leaching of waste components.

BRIEF DESCRIPTION OF THE DRAWINGS

Preferred embodiments of the invention will be further described, by way of non-limiting example only, with reference to the accompanying drawings in which.

DETAILED DESCRIPTION

The present invention is predicated in part on the identification of a composition, the components of which when combined with radioactive and hazardous waste enables robust and efficient encapsulation of that waste.

The present invention is also predicated in part on use of an encapsulating composition, the components of which, when melt mixed with radioactive and/or hazardous waste, enables robust and efficient encapsulation of that waste.

In one form, the encapsulation composition comprises non-biodegradable thermoplastic polymer and wax. The inventor has found that the encapsulating composition can be melt mixed with the radioactive and/or hazardous waste, then cooled to form a solid mass, to provide robust and efficient encapsulation of the waste.

Figure 3:
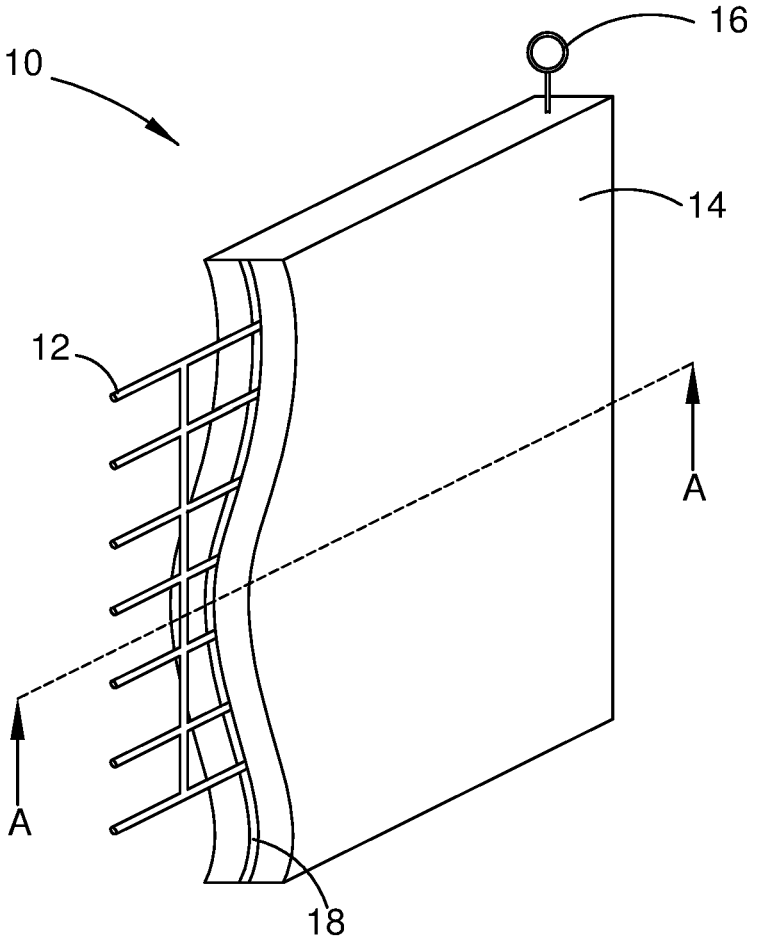
FIG. 3 is a perspective cutaway view of a panel of one embodiment of the invention.

With reference to FIG. 3, there is shown a composite panel 10 according to a preferred embodiment of the present invention. The panel 10 is configured for use in a toxic material encapsulation system and a plurality of panels may be combined to form container 100 shown in FIG. 6.

The panel 10 comprises a reinforcing structure 12 at least partially disposed within a matrix material 14. In one form, the matrix material 14 is a composition including a non-biodegradable thermoplastic polymer such as polyolefin and the reinforcing structure 12 is integrally formed within the matrix material. In other forms, matrix includes a flexibility enhancing additive. In preferred embodiments, the matrix material 14 is a composition including a non-biodegradable thermoplastic polymer such as polyolefin and a wax or fat in which the reinforcing structure 12 is at least partially disposed. The polyolefin material may be new or recycled, singularly or comingled. The fat may be derived from animal or vegetable sources and may be from waste or non-waste sources.

In one embodiment the panel is formed of an encapsulation composition for the encapsulation of radioactive and/or hazardous waste, the encapsulation composition including: a non-biodegradable thermoplastic polymer; and a wax.

In another embodiment, there is provided an encapsulation composition for preventing leaching of radioactive and/or hazardous waste into the environment, the encapsulation composition including: waste, including radioactive and/or hazardous waste; a non-biodegradable thermoplastic polymer; and a wax.

In order to effectively encapsulated the waste, the thermoplastic polymer, wax and the waste can all be combined under pressure and heated to provide a mixture in which the waste is coated in the thermoplastic polymer and wax. This mixture is then extruded in a malleable form into container 100 formed of a similar composition to enable the encapsulated waste to bond to the container 100 to provide a robust encapsulation system which is extremely durable for transportation and resistant to damage during transportation. Advantageously, in the event of a transport accident or other destructive incident, the waste can be collected with potentially only minor external contamination.

It must be able to integrate with the waste and provide a supporting framework to which the waste is bound and held. The inventor has found that a composition which includes a non-biodegradable thermoplastic polymer and a wax when heated to a liquid form, added to the waste, and then cooled to solid form, provides such a robust and efficient encapsulation of the waste.

As used herein, radioactive waste refers to waste that contains radioactive material. Radioactive waste is typically a by-product of nuclear power generation, or is produced from the use of radioactive materials in scientific research, industrial, agricultural and medical applications, and the production of radiopharmaceuticals. Furthermore, in the mining industry, radioactive waste arises from naturally occurring radioactive materials (NORM) that are concentrated as a result of the processing or consumption of coal, oil and gas, and some minerals.

Radioactive waste may be divided into 6 categories—exempt waste (EW), very short lived waste (VSLW), very low level waste (VLLW), low level waste (LLW), intermediate level waste (ILW) and high level waste (HLW). The classification of radioactive waste has been defined in international standards developed by the International Atomic Energy Agency (IAEA Safety Standard Series, No GSG-1, 2009). There are three general classes of radioactive waste—low level waste (LLW), intermediate level waste (ILW) and high level waste (HLW). However, a recent review of the waste classifications has led to the addition of two new classes between LLW and exempt waste. The classifications as set out in a recent publication by the Australian Nuclear Science and Technology Organisation (ANSTO, Management of Radioactive Waste in Australia, January 2011) can be described as follows.

Exempt waste (EW) contains such a low concentration of radionuclides that it can be excluded from nuclear regulatory control because radiological hazards are considered negligible. Very short lived waste (VSLW) can be stored for decay over a limited period of up to a few years and subsequently cleared of regulatory control to be disposed of as regular waste. Very low level waste (VLLW) does not need a high level of containment and isolation and therefore is suitable for disposal in near-surface landfill-type facilities with limited regulatory control. Low level waste (LLW) contains limited amounts of long lived radionuclides. This classification covers a very wide range of radioactive waste, from waste that does not require any shielding for handling or transportation up to activity levels that require more robust containment and isolation periods of up to a few hundred years. There are a range of disposal options from simple near-surface facilities to more complex engineered facilities. LLW may include short lived radionuclides at higher levels of activity concentration, and also long-lived radionuclides, but only at relatively low levels of activity concentration. LLW is generated from hospitals and industry, as well as the nuclear fuel cycle. LLW therefore typically includes radioactive material found in evaporator concentrate, ion exchange resins, incinerator bottom ash, filtration sludges, and contaminated filters and membranes. Intermediate level waste (ILW) typically includes resins, chemical sludge and metal reactor nuclear fuel cladding, as well as contaminated materials from reactor decommissioning. ILW contains increased quantities of long-lived radionuclides and needs an increase in the containment and isolation barriers compared to LLW. ILW needs no provision for heat dissipation during storage and disposal. Long lived radionuclides such as alpha emitters will not decay to a level of activity during the time for which institutional controls can be relied upon. Therefore ILW requires disposal at greater depths of tens to hundreds of metres.

High level waste (HLW) is produced by nuclear reactors. It contains fission products and transuranic elements generated in the reactor core. HLW has high levels of activity that generate significant quantities of heat by radioactive decay that need to be considered in the design of a disposal facility. Disposal in deep, stable geological formations usually several hundreds of metres below the surface is generally recognised as the most appropriate option for HLW. The two primary classes of civilian HLW are used fuel from nuclear power reactors and separated waste arising from the reprocessing of that used fuel.

As used in the present disclosure, hazardous waste refers to waste that poses, or has the potential to pose, a danger to human health and the environment if it is not properly treated, stored, transported, disposed of, or otherwise managed in an appropriate manner. In the United States, the treatment, storage and disposal of hazardous waste is regulated under the Resource Conservation and Recovery Act (RCRA). At 40 CFR 261 of that Act, hazardous wastes are divided into two major categories, namely characteristic wastes and listed wastes. Characteristic hazardous wastes are materials that are known or tested to exhibit one or more of the following four hazardous traits—ignitability (i.e., flammable), reactivity, corrosivity, and toxicity. Listed hazardous wastes are materials specifically listed by regulatory authorities as a hazardous waste which are from non specific sources, specific sources, or discarded chemical products. In Australia, hazardous waste is defined in the Hazardous Waste (Regulation of Exports and Imports) Act 1989 under four categories. These include: (1) waste prescribed by the Regulations of the Act, where the waste has any of the characteristics mentioned in Annex Ill to the Basel Convention (these characteristics include explosive materials, flammable liquids and solids, poisonous substances, toxic substances, ecotoxic substances and infectious substances); (2) wastes that belong to any category contained in Annex I to the Basel Convention, unless they do not possess any of the hazardous characteristics contained in Annex Ill (wastes in Annex I include clinical wastes, waste oils/water, hydrocarbons/water mixtures, emulsions, wastes from the production, formulation and use of resins, latex, plasticizers, glues/adhesives, wastes resulting from surface treatment of metals and plastics, residues arising from industrial waste disposal operations; and wastes which contain certain compounds such as copper, zinc, cadmium, mercury, lead and asbestos); (3) household waste; and (4) residues arising from the incineration of household waste.

The encapsulation composition can include waste which is in a dry or near-dry form. In this regard, the waste may have moisture content in a range from about 0% to about 10% by weight. However, it should be made clear that the waste need not be in such a dry or near-dry form. The advantages of the waste being in such a form are primarily for the purposes of reducing waste volume prior to encapsulation and containment. When waste is to be provided in a dry or near-dry form, pre-treatment steps are required to render the waste substantially anhydrous. This can include heating the waste in an incinerator or oven, or by using a vacuum dryer system, followed optionally by grinding, crushing or milling the dry or near-dry waste to further reduce the volume.

When the waste is in a dry or near-dry form, loadings of waste in the encapsulation composition may be from about 10% to about 85% by weight.

Wet waste may also be handled according to the embodiments described herein and may be placed directly into a container of the type described. Such waste may be mixed with wax at a low temperature for encapsulation.

If required, prior to being melt mixed with the encapsulating composition the waste may be comminuted. Comminution may be achieved using techniques known in the art such as grinding, shredding, crushing or milling.

In one embodiment, the radioactive and/or hazardous waste undergoes comminution before being melt mixed with the encapsulation composition.

The encapsulating composition may comprise non-biodegradable thermoplastic polymer and wax. The non-biodegradable thermoplastic polymer, together with the wax, forms a blend that functions as a binder to bind together and encapsulates the waste. As a binding composition, it has a number of advantages over the use of conventional binders such as cement. For example, it enables higher waste loading than the use of cement, solidification of the composition upon cooling is assured (by virtue of being thermoplastic—both the wax and polymer are thermoplastic) given that no chemical curing is required, and the composition can accommodate a wide range of waste types because constituents in the waste will not interfere with its solidification upon cooling.

Any non-biodegradable thermoplastic polymer may be used in the described encapsulation composition. Those which are softened or in a molten form from about 120° C. to about 260° C. are most convenient in terms of reducing energy costs when formulating the composition or when mixing the composition with the radioactive and/or hazardous waste. Such polymers would be known in the art, and include, but are not limited to, polyethylene (including low density polyethylene (LDPE) and high density polyethylene (HDPE)), polypropylene, acrylic, polyvinyl ethylene, polyvinyl acetate, polyvinyl chloride (PVC), polystyrene, nylon, polybutadiene, and mixtures thereof.

Polyethylene is an inert thermoplastic polymer with a melting temperature dictated by its density. Therefore, melting temperatures can range from 105° C. (for lower density polyethylene) to 130° C. (for higher density polyethylene). As a binding agent, it has a number of advantages over the use of conventional binding agents such as cements. For example, polyethylene encapsulation enables higher waste loading than the use of cement, solidification of the polyethylene upon cooling is assured given that no chemical curing is required, and polyethylene can accommodate a wide range of waste types because constituents in the waste will not interfere with the solidification upon cooling.

Polyethylene may be classified into several different categories based on characteristics such as its density and branching. Its mechanical properties depend significantly on variables such as the extent and type of branching, the crystal structure and the molecular weight. When categorised according to density, polyethylene exists in a number of forms, the most common being high density polyethylene (HDPE), linear low density polyethylene (LLDPE), and low density polyethylene (LDPE). HDPE is defined by a density of greater or equal to 0.941 g/cm3.

HDPE has a low degree of branching and thus has stronger intermolecular forces and tensile strength than LLDPE and LDPE. HDPE is produced by chromium/silica catalysts, Ziegler-Natta catalysts or metallocene catalysts. The lack of branching is ensured by an appropriate choice of catalyst (for example, chromium catalysts or Ziegler Natta catalysts) and reaction conditions. HDPE is used in products and packaging such as milk jugs, detergent bottles, margarine tubs, garbage containers and water pipes.

LLDPE is defined by a density range of 0.915-0.925 g/cm3. LLDPE is a substantially linear polymer with significant numbers of short branches, commonly made by copolymerization of ethylene with short-chain alpha-olefins (for example, 1-butene, 1-hexene and 1-octene). LLDPE has higher tensile strength than LDPE, and exhibits a higher impact and puncture resistance than LDPE. LLDPE is commonly used in packaging, particularly film for bags and sheets, saran wrap, and bubble wrap.

LDPE is defined by a density range of 0.910-0.940 g/cm3. LDPE has a high degree of short and long chain branching, which means that the chains do not pack into the crystal structure as well. It has, therefore, less strong intermolecular forces as the instantaneous-dipole induced-dipole attraction is less. This results in a lower tensile strength and increased ductility. The high degree of branching with long chains gives molten LDPE unique and desirable flow properties. LDPE is most commonly used for manufacturing various containers, dispensing bottles, wash bottles, tubing, and plastic bags for computer components. However, its most common use is in plastic bags.

In one embodiment, LDPE is the preferred non biodegradable thermoplastic polymer for use in the encapsulation composition.

In some embodiments, the non-biodegradable thermoplastic polymer may be present in the encapsulation composition in an amount from about 0.5% to about 30% by total volume. In some embodiments, the polymer may be present in an amount from about 0.5% to about 25%, from about 0.5% to about 20%, from about 0.5% to about 15%, from about 0.5% to about 10%, from about 0.5% to about 5%, from about 5% to about 30%, from about 5% to about 25%, from about 5% to about 20%, from about 5% to about 15%, from about 5% to about 10%, from about 10% to about 30%, from about 10% to about 25%, from about 10% to about 20%, from about 10% to about 15%, from about 15% to about 30%, from about 15% to about 25%, from about 15% to about 20%, from about 20% to about 30%, or from about 20% to about 25%, by total volume of the encapsulation composition.

The encapsulation composition also includes a wax. As would be understood by a person skilled in the art, waxes belong to a class of chemical compounds that are malleable near ambient temperatures. Characteristically, waxes melt above 45° C. to give a low viscosity liquid. Waxes are hydrophobic but are soluble in organic, nonpolar solvents. All waxes are organic compounds which are both synthetic and naturally derived. Natural waxes are typically esters of fatty acids and long chain alcohols. Synthetic waxes are long-chain hydrocarbons lacking functional groups.

Suitable waxes may include any of various hydrocarbons (straight or branched chain alkanes or alkenes, ketone, diketone, primary or secondary alcohols, aldehydes, sterol esters, alkanoic acids, turpenes, monoesters), such as those having a carbon chain length ranging from C1rC3s. Also suitable are diesters or other branched esters. The compound may be an ester of an alcohol (glycerol or other than glycerol) and a C18 or greater fatty acid.

In some embodiments, the wax is selected from one or more of the group consisting of mineral waxes such as paraffin, beeswax (e.g. White Beeswax SP-422P available from Strahl and Pitsch of West Babylon, N.Y.), Chinese wax, lanolin, shellac wax, spermaceti, bayberry wax, candelilla wax, vegetable waxes such as carnauba wax, insect wax, castor wax, esparto wax, Japan wax, jojoba oil, ouricury wax, rice bran wax, soy wax, lotus wax (e.g., Nelumbo Nucifera Floral Wax available from Deveraux Specialties, Silmar, Calif.), ceresin wax, montan wax, ozocerite, peat waxes, microcrystalline wax, petroleum jelly, Fischer-Tropsch waxes, substituted amide waxes, cetyl palmitate, lauryl palmitate, cetostearyl stearate, polyethylene wax (e.g. PERFORMALENE 400, having a molecular weight of 450 and a melting point of 84° C., available from New Phase Technologies of Sugar Land, Tex.), and silicone waxes such as C3o-45 Alkyl Methicone and C3o-45 Olefin (e.g. Dow Corning AMS-C30, having a melting point of 70° C., available from Dow Corning of Midland, Mich.).

In one embodiment, paraffin is the preferred wax for use in the encapsulation composition.

In some embodiments, the wax may be present in the encapsulation composition in an amount from about 0.5% to about 99.5% by total volume. In some embodiments, the wax may be present in an amount from about 20% to about 80%, from about 30% to about 70%, or from about 40% to about 60%, by total volume of the encapsulation composition.

In some embodiments, the encapsulation composition may also include an anhydrous, anti-leaching agent. Such agents are able to form precipitates with the radioactive or toxic components of the waste. Examples of suitable anhydrous, anti leaching agents include, but are not limited to, sodium sulphide, calcium hydroxide, sodium hydroxide, calcium oxide, magnesium oxide, and mixtures thereof.

In some embodiments, sodium sulphide is the preferred anhydrous, anti-leaching agent to use in the encapsulation composition.

In some embodiments, the anhydrous, anti-leaching agent is present in the encapsulation composition in an amount from about 5% to about 60% by total volume. In some embodiments, the anhydrous, anti-leaching agent may be present in an amount from about 5% to about 55%, from about 5% to about 50%, from about 5% to about 45%, from about 5% to about 40%, from about 5% to about 35%, from about 5% to about 30%, from about 5% to about 25%, from about 5% to about 20%, from about 5% to about 15%, from about 5% to about 10%, from about 10% to about 50%, from about 20% to about 40%, or from 30% to about 40%, by total volume of the encapsulation composition.

In some embodiments, the encapsulation composition is in a molten or liquid form at temperatures above about 120° C. In a molten form, the combined polymer and wax of the encapsulation composition are capable of interspersing with the waste, which upon cooling gives rise to a monolithic solid waste form representing a robust and efficient encapsulation of the waste. In effect, the combination of the polymer and wax is acting as a binding agent for the waste.

The encapsulation composition may be in the form of solid pellets containing the polymer and wax. Such pellets can be prepared using standard techniques known in the art. Typically, these involve heating the polymer and the wax (together or separate) to a molten or liquid phase, mixing the two molten components together (if heated separately), and then forcing the molten composition to flow through a die plate before being cut into pellets and allowed to solidify. If the encapsulation composition is to include an anhydrous, anti-leaching agent, the agent can be added either to the molten polymer or the molten wax prior to mixing, or to the molten polymer and wax when combined. In one form, the pellets are separately mixed with molten wax prior to use to coat the pellets, which can be broken up ready for subsequent use. This enables the pellets to be mixed with the waste so that both components can be heated together.

Having identified that the specific combination of a non-biodegradable thermoplastic polymer and a wax provides a robust and reliable encapsulation composition for radioactive and/or hazardous waste, the present disclosure provides a method for the encapsulation of said waste using said composition.

Also, having selected a specific combination of a non-biodegradable thermoplastic polymer and wax that provides a robust and reliable encapsulation composition for the selected radioactive and/or hazardous waste, the present disclosure provides for encapsulation of the waste by melt mixing the waste with the encapsulation composition.

As used herein the expression "melt mixing" is intended to mean a mechanical process whereby the encapsulation composition and the waste are mechanically mixed with the encapsulation composition while it is in a molten state. Melt mixing is therefore intended to be distinct from the mere addition of the waste to molten encapsulation composition (where mixing and dispersion of the waste through the encapsulation composition will be limited and rather ineffective.

The expression "melt mixing" may therefore also be referred to as "mechanical melt mixing".

Melt mixing can advantageously be performed using techniques and equipment known in the art. For example, melt mixing may be achieved using continuous extrusion equipment such as twin screw extruders, single screw extruders, other multiple screw extruders and Farell mixers.

When preforming the method, the encapsulation composition and the waste may be introduced into the melt mixing equipment together or separately. The components that make up the encapsulation composition may also be introduced into the melt mixing equipment together or separately. The encapsulation composition may itself have been formed prior to performing the method by melt mixing non-biodegradable thermoplastic polymer, the wax and optionally one or more additives such as the anhydrous anti-leaching agent.

In one embodiment, the encapsulation composition is provided in the form of pellets, the pellets having a core-shell structure, with the core comprising the non-biodegradable thermoplastic polymer and shell comprising the wax.

Such a core-shell encapsulation composition structure can be produced simply by obtaining the polymer in the form of pellets and mechanically mixing the pellets with molten wax so as to coat the outside of the pellets and form an outer wax shell. Any additive to be used in the encapsulating composition can be incorporated into the outer wax shell by mixing it with the molten wax and using that wax mixture to form the wax based shell.

There is also disclosed herein a method of encapsulation and containment of radioactive and/or hazardous waste, the method including:

(i) providing the radioactive and/or hazardous waste to be encapsulated and contained;

(ii) mixing the waste of step (i) with an encapsulation composition including a non-biodegradable thermoplastic polymer and a wax;

(iii) heating the waste and encapsulation composition mix of step (ii) such that the encapsulation composition is in a molten or liquid form, thereby encapsulating the waste; and (iv) depositing the mix of step (iii) into a container, thereby containing the waste.

Figure 1:
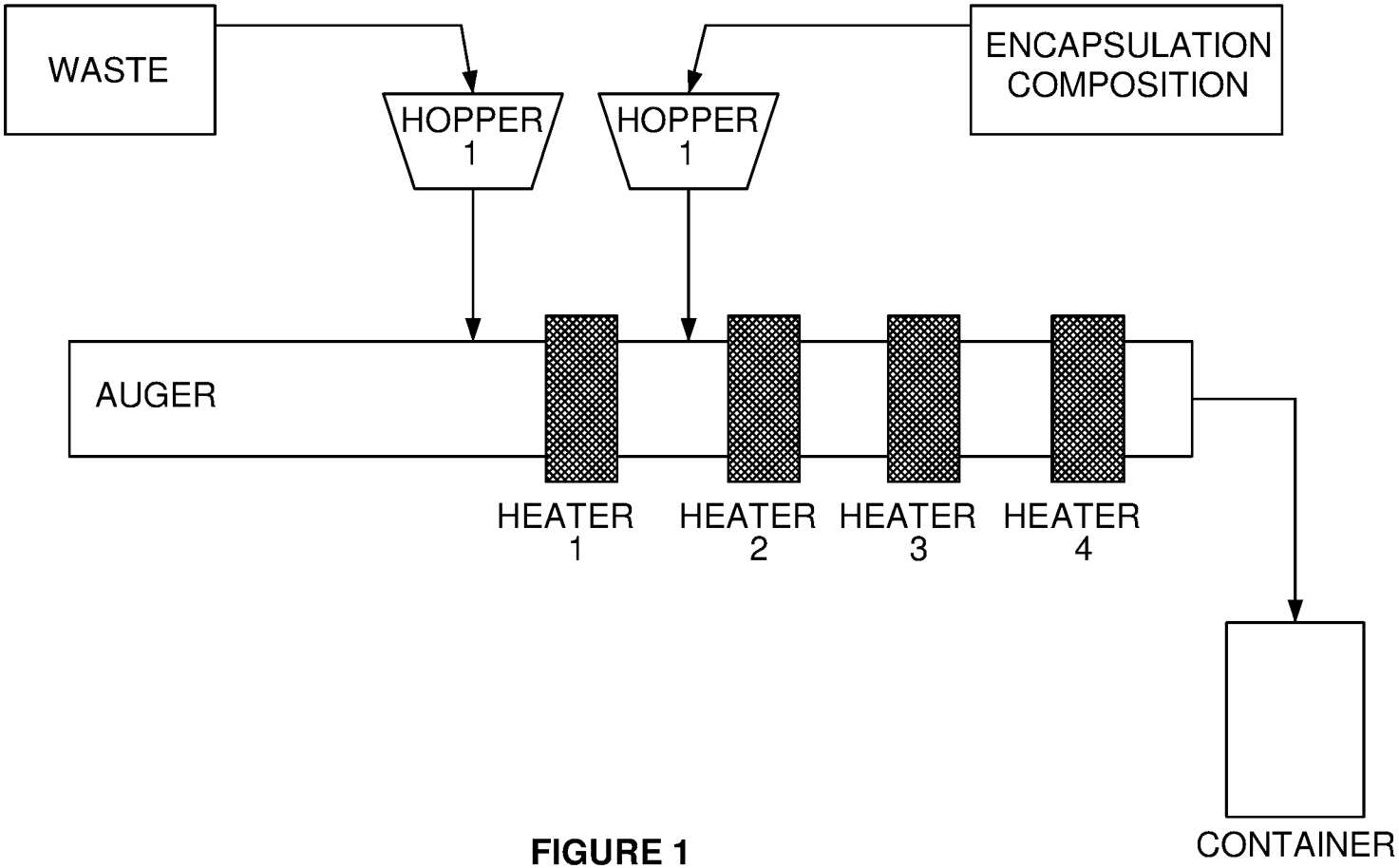
FIG. 1 is a flow diagram of a method of encapsulation and containment of radioactive and/or hazardous waste according to an embodiment of the present invention.

This method is illustrated in the flow diagram of FIG. 1. Here it can be seen that the radioactive and/or hazardous waste is fed into an auger via a hopper (hopper 1). The feeding process is automated and preferably microprocessor controlled. The waste can be fed into the hopper in its native state, or it can be first subject to drying using methods as described above. In this case, the waste is fed into the hopper in a dry or near-dry form. If the waste is provided in its native state, it may optionally be subject to drying within the auger, as effected by a heating element in, or associated with, the auger (heater 1) prior to mixing with the encapsulation composition. In one embodiment, the waste (in its dry, near-dry, or native form) may be ground, crushed or milled prior to being fed into the hopper.

The encapsulation composition, for example in the form of pellets as described above, can be added separately to the auger via an independent hopper (hopper 2). The auger then facilitates mixing of the waste and encapsulation composition before the mix is heated by a separately controlled second heating element in, or associated with, the auger (heater 2). In some embodiments, the auger may have 1, 2 or more additional heating elements positioned after heater 2. This allows a homogeneous, molten mixture of all components to be obtained which ensures appropriate encapsulation of the waste. The mixture is then deposited into a container and allowed to cool to an ambient temperature such that a monolithic solid is formed within the container, thereby containing the waste for subsequent storage.

As indicated above, the feeding process for addition of the encapsulation composition to the auger is automated and preferably microprocessor controlled. In this regard, each individual feeder is regulated by a master controller which monitors and adjusts the delivery of the waste and encapsulation composition to maintain the required or desired weight ratio amongst the components of the mixture.

Any auger may be utilised in the described method, such as a single or multiple screw configuration, provided that it is properly sized. Zone temperatures, melt temperatures, melt pressures, current draw and screw speed are parameters which should be carefully monitored by appropriate instrumentation throughout the process.

In certain situations and locations, it may not be possible to grind crush or mill the waste prior to mixing with the encapsulation composition. It also might not even be possible to dry the waste prior to this step. For example, a substantial amount of radioactive and hazardous waste is generated by medical applications, such as in hospitals and research institutes, and these sites might not have the infrastructure and resources required to implement such steps. Therefore, an alternative method for such sites would be to compact the waste (in its neat form) into the container using physical force or mechanically by means of a hydraulic compressor. The waste need not be compacted but in the interests of saving space with respect to subsequent storage of contained waste it is preferred. Once the container is full of waste (compacted or not), the encapsulation composition in a molten form can be added to the waste, allowed to intersperse with the waste, and then allowed to solidify in the container thereby encapsulating and containing the waste. A seal or lid can then be applied to the container for subsequent storage purposes.

An advantage of the encapsulation composition is that it may be reused for future encapsulation requirements. With respect to radioactive waste as an example, once the encapsulated radioactive waste has decayed sufficiently (according to applicable regulations) after storage, the encapsulation composition can be reheated to a molten form allowing its separation from the decayed waste. The molten encapsulation composition can then be reused for subsequent encapsulation needs. Furthermore, for waste containing heavy metals the radioactivity of which has decayed sufficiently, the heavy metals may be harvested for reuse in subsequent applications after application of heat and/or a solvent such as kerosene. This recycling of components is simply not possible with conventional binding agents such as cements and the like.

The molten mixture produced may comprise the waste encapsulated in the encapsulating composition. Upon cooling, this molten mixture can solidify into a monolithic solid which can be readily transported for subsequent storage. The solidified encapsulating composition comprising the waste encapsulated therein is very robust and not prone to leaching of the waste.

The molten mixture comprising the waste encapsulated in the encapsulating composition may be deposited into a container and allowed to cool to an ambient temperature such that a monolithic solid is formed within the container, thereby containing the waste for subsequent storage.

Accordingly, in one embodiment the method further comprises depositing the so formed encapsulated waste while still in a molten form into a container, thereby containing the encapsulated waste.

By depositing the so formed encapsulated waste while still in a molten form into a container the encapsulated waste forms the shape of the container. The container can be designed for easy of sealing, transport and storage.

In some embodiments, the container is constructed of a container composition including a non-biodegradable thermoplastic polymer and a filler or reinforcing fibre. The components of the container composition are "clean" in that they in themselves do not contain any radioactive waste or toxic chemicals. In effect, this renders the container "clean" and therefore further minimises that leachability of contaminants trapped at or near the surface of the encapsulated waste.

In one embodiment, the non-biodegradable thermoplastic polymer of the container composition is selected from the group consisting of polypropylene, high density polyethylene (HDPE), polyester, polyolefin, polyamide, polyvinylidene fluoride, polyvinylidene chloride, and mixtures thereof.

In one embodiment, the non-biodegradable thermoplastic polymer of the container composition is polypropylene. In a further embodiment, the non-biodegradable thermoplastic polymer of the container composition is HDPE. Both polypropylene and HDPE are consistently used for container construction due to their physical strength, chemical resistance and an acceptable dampening effect on gamma radiation.

In some embodiments, the non-biodegradable thermoplastic polymer of the container composition is present in an amount of from about 10% to about 90% by total volume of the container composition. In some embodiments, the non-biodegradable thermoplastic polymer may be present in an amount from about 20% to about 80%, from about 30% to about 70%, or from about 40% to about 60%, by total volume of the container composition.

The purpose of the filler or reinforcing fibre of the container composition is to provide additional support and strength to the container. Appropriate fillers and fibres would be known to a person skilled in the art. However, for the purposes of clarity, examples may include, but are not limited to, those selected from one or more of the group consisting of dry clean or waste wood powder, glass fibre, carbon fibre, aramide fibre, silicon carbide fibre, boron fibre, alumina fibre, aromatic polyamide fibre, high elastic polyester fibre, Kevlar, hemp, jute or sisal. In one embodiment of the present invention, the filler or reinforcing fibre of the container composition is dry wood powder. In one embodiment, the dry wood powder has a particle size no greater than 2 millimetres.

In some embodiments, the filler or reinforcing fibre is present in an amount of up to about 30% by total volume of the container composition. In some embodiments, the filler or reinforcing fibre may be present in an amount from about 0% to about 30%, from about 0% to about 25%, from about 0% to about 20%, from about 0% to about 15%, from about 0% to about 10%, from about 0% to about 5%, from about 5% to about 30%, from about 5% to about 25%, from about 5% to about 20%, from about 5% to about 15%, from about 5% to about 10%, from about 10% to about 30%, from about 10% to about 25%, from about 10% to about 20%, from about 10% to about 15%, from about 15% to about 30%, from about 15% to about 25%, from about 15% to about 20%, from about 20% to about 30%, or from about 20% to about 25%, by total volume of the container composition.

The thickness of the walls and base of the container will generally be dictated by the nature of the waste it is to contain. For example, waste that is anticipated to be heavy once compacted into the container will require a container which is thicker than waste which comprises light weight material or where there is only a small amount of waste to be contained. In some embodiments, the walls and base of the container will have a thickness of from about 3 millimetres to about 10 millimetres. However, it is to be understood that the walls and base of the container may be any thickness designed to suit the situation and the nature of the encapsulated waste to be contained.

The container must be load bearing when encapsulated waste is present in the container. This is to ensure that the integrity of the container is not compromised at any time during subsequent handling, transport and/or storage. It is preferable that the container be load bearing to a capacity of at least 5 times that of the weight of the encapsulated waste present in the container, including the weight of the container itself.

In instances where the container is to be used to contain radioactive wastes where storage for extended periods of time are required, including deep burial requirements, the load bearing of the container may need to be increased to ensure integrity. In such instances, during fabrication of the container additional reinforcing means may be incorporated into the molding and forging process. The reinforcing means may be internal and/or external to the container and the nature of the reinforcing means would be understood by a person skilled in the art.

For example, in one embodiment, the reinforcing means are internal reinforcing means which include one or more supports or rods positioned in the walls and/or base and the lid of the container. The supports or rods may be constructed of any suitable tensile material capable of withstanding load bearing, and other external, forces. In one embodiment, the supports or rods are made of steel. When positioned in the walls of the container, the internal reinforcing means may extend substantially horizontally and circumferentially around the container, or may extend substantially vertically and circumferentially around the container, at interspersed intervals.

In one embodiment, the reinforcing means are external reinforcing means which may be imparted by a geometric design incorporated as part of the surface of the container walls, for example. The geometric designs are typically blow molded during fabrication of the container and can include such shapes as circular indentations, squares, rectangles, rounds, ovals, triangles, diagonal ribs, corrugations, and honeycomb imitations.

In certain embodiments, the geometric designs of the external reinforcing means enable efficient storage of the containers in that they may provide container surfaces which can interlock with the surfaces of adjacently stored containers. Corrugations are a typical example; however, other geometric shapes may afford the same functionality. Efficiency of storage may also be enhanced by fabricating the container into a square or rectangular shape to allow effective stacking of the containers. This is particularly important in hospitals and research institutes where encapsulated waste is stored on-site and storage space is at a premium.

Once the encapsulated waste has been contained in the container, the container is sealed. This can be effected by a number of means as would be understood by a person skilled in the art. For example, the container may have a dedicated lid that is sealed to the container by any one or more of various means, including reliance on a seal being created by the solidification of molten encapsulation composition present on top of the encapsulated waste, use of an independent adhesive, or use of clips or the like which are located where the walls of the container engage with the lid.

Figure 2:
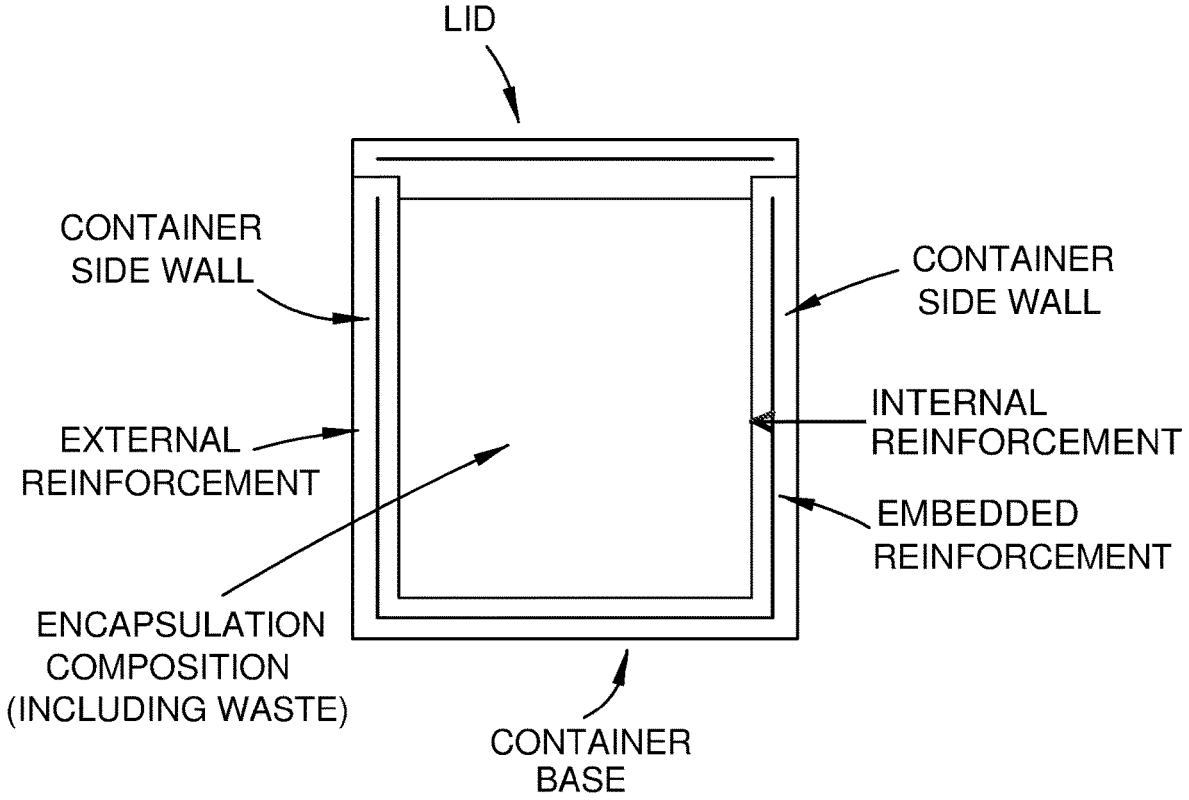
FIG. 2 is a representation of a container for containment of radioactive and/or hazardous waste which has been encapsulated according to an embodiment of the present invention.

FIG. 2 shows an example of a container according to an embodiment of the present invention which is both internally and externally reinforced. In addition, reinforcement may be embedded in the wall of the container. In the embodiment shown, the lid of the container also comprises an internal reinforcement.

For the containment of radioactive waste, the interior of the container may also be lined with lead. Lead acts as a form of radiation protection to shield people or objects from radiation. Lead can effectively attenuate certain kinds of radiation because of its high density and high atomic number; principally, it is effective at stopping gamma radiation. However, lead is not effective against all types of radiation, including beta radiation, in which case it should not be used.

The lead lining may be in the form of a sheet placed on the internal sides and bottom of the container (and on the underside of the lid) before the container is filled with the encapsulated waste, or lead may form an integral part of the container by being incorporated into the container composition during molding and forging of the container.

There is also disclosed herein a system for the encapsulation and containment of radioactive and/or hazardous waste, the system including:

(i) an encapsulation composition for the encapsulation of the radioactive and/or hazardous waste, the encapsulation composition including a non-biodegradable thermoplastic polymer, and a wax; and (ii) a container for receiving the encapsulation composition.

For a description of the components of the system, including the nature of the non biodegradable thermoplastic polymer, wax and container, reference should be made to the description above.

In preferred embodiments, the matrix material comprises a large percentage of wax and a small percentage of low density polyethylene (LDPE), such as for example, 99.5% by weight wax and 0.5% by weight LDPE. Advantageously, the panels can be easily formed and after use, easily remelted for recycling.

Returning to FIG. 3, in the illustrated embodiment, the reinforcing structure 12 is encapsulated within and spans the extent of the panel 10, thereby providing structural reinforcement to the panel 10. Such a panel configuration takes advantage of the different properties of the constituents of the matrix material 14 to achieve a panel 10 for use in an encapsulation system which is far superior to those previously proposed. In this regard, the radiation absorbing properties and longevity of a non-biodegradable thermoplastic polymer, combined with the anti-leaching properties of the wax or fat (which also improves formability/mouldability of the composition), and the structural strength of the reinforcing structure 12 combine to provide a panel having sufficient material performance and structural strength for use in encapsulating toxic materials is a cost effective manner. Also, by encapsulating the reinforcing structure 12 within the matrix material, it can be protected from corrosion, a major problem with previous systems.

In a preferred form, the panel 10 includes engagement members coupled to the reinforcing structure 12 and extending externally of the panel 10, thereby allowing the panel to be conveniently handled without excessive manual engagement. The engagement members are shown in the form of loops 16, though may also be in the form of apertures, hooks or other fastening members.

In a preferred form, the panel 10 is formed by applying the matrix material 14 in liquid form to the reinforcing material 12 in a mould. In other forms, the panel 10 may be of sandwich construction, which in one example is formed by fusing inner and outer panels around the matrix material 14, and in other forms, by providing inner and outer sheets between which a molten matrix is poured. In one form, the panel 10 may be relatively thin and flexible and supplied in the form of a rolled up sheet or foil, between which a foam or wax mixture may be disposed.

It will be appreciated that the matrix material 14 will have a relatively low melting point owing to its composition, possibly in the order of 120 degrees Celsius, though the actual melting point will depend on the actual composition of the matrix material 14. Such a low melting point allows conventional moulding techniques to be used for forming the matrix material 14 so that the panel 10 may be moulded in planer or three dimension form or into an encapsulation container, as will be described further below. By moulding the panels together as an encapsulation container, it may be formed as a sealed body and take a rectangular form which makes efficient use of space to reduce the cost of storage and/or transportation.

In the illustrated embodiment, the panel 10 includes a radiation shield 18 integrally formed within the panel. The radiation shield 18 may be provided for applications in which particularly strong nuclear radiation is to be encountered and may include a moderator such as graphite or boron. Although the radiation shield 18 is shown as a layer formed within the panel 10 (see also illustrated in FIG. 10), it will be appreciated that the radiation shield 18 may be affixed to an internal or external surface of the panel 10. The radiation shield may be in the form of a further layer of a composition including a non-biodegradable thermoplastic polymer and a wax or fat, the thickness of which is tailored to the application.

Figure 4:
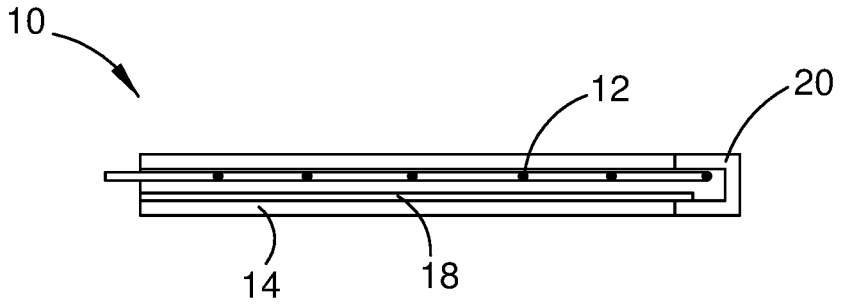
FIG. 4 is a sectional view of the panel.

The shield 18 may also be formed of multiple layers. In one form, the panel is formed with an edge reinforcing element, such as the member 20 shown in FIG. 4 having a 'C' cross-sectional shape, which engages the reinforcing material 12 and/or the radiation shield 18 to hold it in position and provide increased structural strength.

In alternative forms, the shield may be in liquid form including for example boron, graphite, water, wax or fat, or combinations thereof.

Such a configuration is particularly useful for shipping materials such as uranium oxides which includes a small percentage of U235 which radiated neutron radiation. In current use, yellow cake is shipped in steel drums for processing, then after enrichment (pure U235 is desired), depleted uranium U238 (which is unwanted low level radiating waste) put back in the same steel drums to be shipped to repository to be stored. Neutron radiation is very difficult to shield with any high density metal such as lead, therefore there is a need for a better safety method and system such as the present invention where shield 18 is used in a container for transporting yellow cake to an enrichment centre and after U235 is separated, the shield can be melted or removed for other use. With the shield 18 removed, the empty container could be used to transport the depleted uranium to a repository location. When transporting depleted uranium, the encapsulation composition may be 10% wax and 90% LDPE.

In another embodiment, the edge reinforcing member may have other cross sectional shapes to assist in retaining walls of the encapsulation container in position. In one example, the edge reinforcing member may have a star shaped cross section and be in the form of a star picket for example. Such a configuration may provides a panel to be received against edges of the member so that pressure from material in the container holds the panel in position. Such a configuration may also provide a cavity which can be filled with other materials, such as a moderator for example.

The panel can also include at least one support (not shown) extending from a surface of the panel for supporting a toxic material from the surface of the panel 10. The support preferably extends from a side of the panel 10 which is internal in use. In addition to providing protection to the panel 10, such a configuration allows, when multiple panels are together combined to form an enclosure, water or other materials to be introduced into the enclosure for use as a moderator that surrounds the toxic material. Examples of moderators include carbon suspended in fat or water, borated water or boron suspended in a fat, wax, polymer or gel. Providing a liquid or gel within the enclosure is also useful to reduce flammability.

The reinforcing material 12 can take many forms, including a plurality of tension bars, such as round reinforcing rods. Flat strip elements may also be used and the reinforcing material 12 can also be in the form of a mesh, netting or chain link, which may or may not be provided with a protective plastic coating. External reinforcement members, such as corner protection members, may be disposed externally of the matrix material 14 to provide additional protection to the matrix material 14, particularly when the panel 10 is to be used as an encapsulation container that is to undergo transportation. In one form, the corner protection members may be formed of galvanised iron right angle sections so as to be rust resistant.

To allow multiple panels 10 to be combined as an encapsulation container, additional features may be provided in at least one of the panels, such as a gas discharge vent (not shown). This allows relief of gas pressure to avoid explosions, which can be the result of excessive heating, use of incompatible waste in the box or bond scission due to radioactive chemistry.

Figure 5:
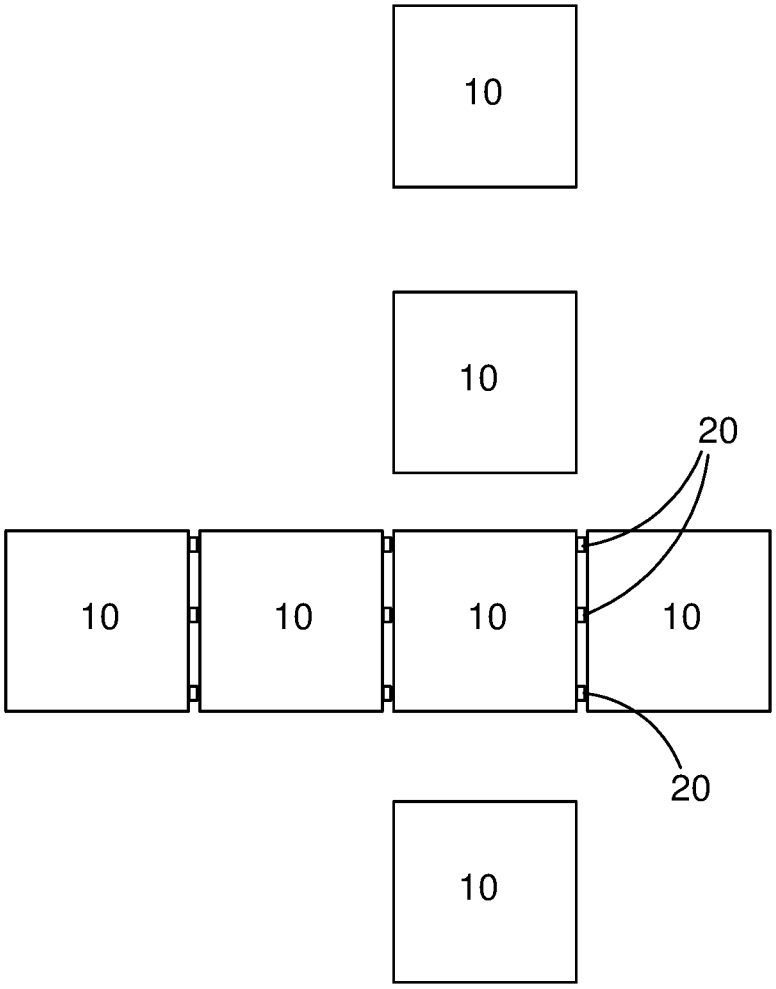
FIG. 5 is a plan view of a plurality of interconnected panels.

Also, as illustrated in FIG. 5, the panel 10 may be formed with hinges 20 disposed along at least one edge to allow a plurality of panels 10 to be conveniently coupled together. Advantageously, by providing panels in this manner, an encapsulation container can be shipped conveniently as a 'flat pack' without incurring large shipping costs and quickly assembled on site. In such embodiments, the panels may be provided with interlocking edges to promote sealing or may be provided with heating means to allow the edges of adjacent panels to be heat fused together, as will be further described below.

Figure 6:
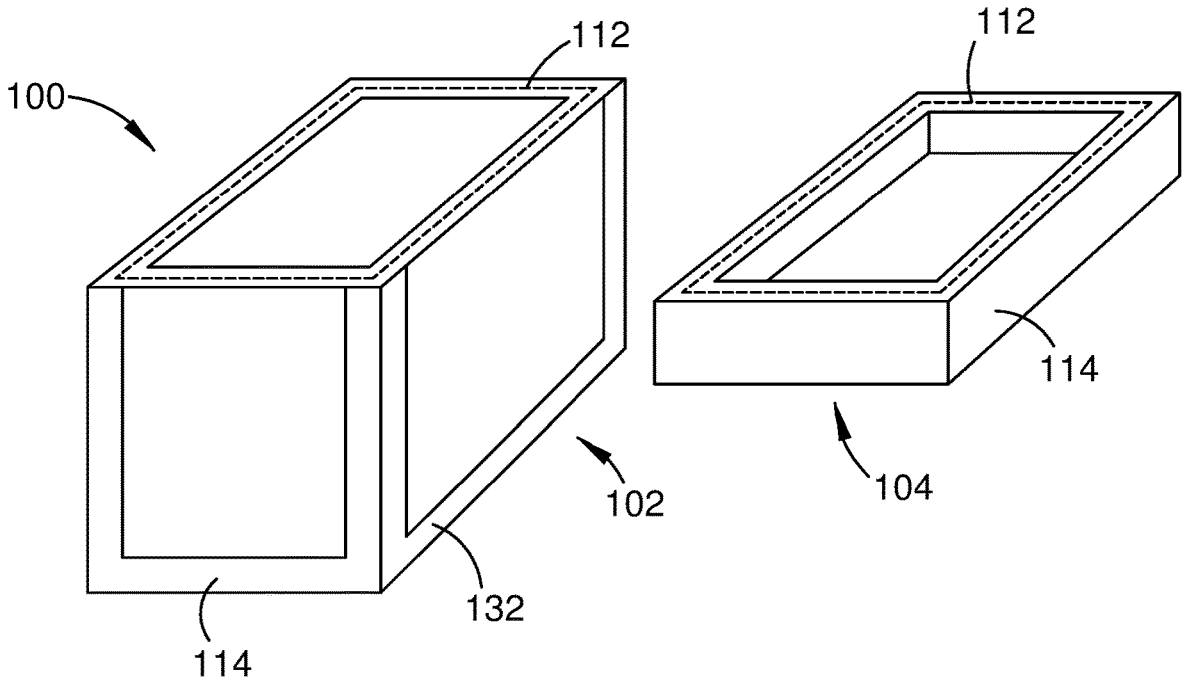
FIG. 6 is a perspective view of a container and lid of one embodiment of the invention.

FIG. 6 illustrates a container 100 for encapsulating toxic materials according to a preferred embodiment of the invention. The container 100 is also configured for use in a toxic material encapsulation system and comprises a reinforcing structure 112 at least partially disposed within a matrix material 114. The matrix material 114 is a composition including a non-biodegradable thermoplastic polymer such as polyolefin and a wax or fat.

The container may be formed in the same manner as panel 10 and, in one embodiment is of unitary construction, though in other embodiments is formed from a plurality of panels 10. In the illustrated embodiment, the container 100 includes a lower housing 102 and lid 104, each of which comprise a reinforcing structure 112 at least partially disposed within a matrix material 114. The matrix material 114 is a composition including a non-biodegradable thermoplastic polymer and a wax or fat.

The container is configured to be sealed watertight in use, which is an inherent property when of unitary construction if manufactured by moulding processes for example, though when formed of a plurality of panels, sealing means may be required. Once sealed, an advantage of the present invention is that the encapsulation composition absorbs 0% water, an advantage of was being hydrophobic or water repellent. The result is an excellent water barrier. This property can be utilised in an embodiment of the invention in which the container is filled with liquid to act as a nuclear water pool. The liquid may be distilled water and/or fat and may include boron or carbon. This provides a container having excellent radiation absorbing properties. Furthermore, as the container has excellent sealing characteristics, the waste may be stored under water or underground with little risk of leaching.

The container 100 can provide a significant improvement over prior art encapsulation containers and methods while meeting transportation, storage and waste management codes. Furthermore, incineration of waste can be avoided.

Figure 7:
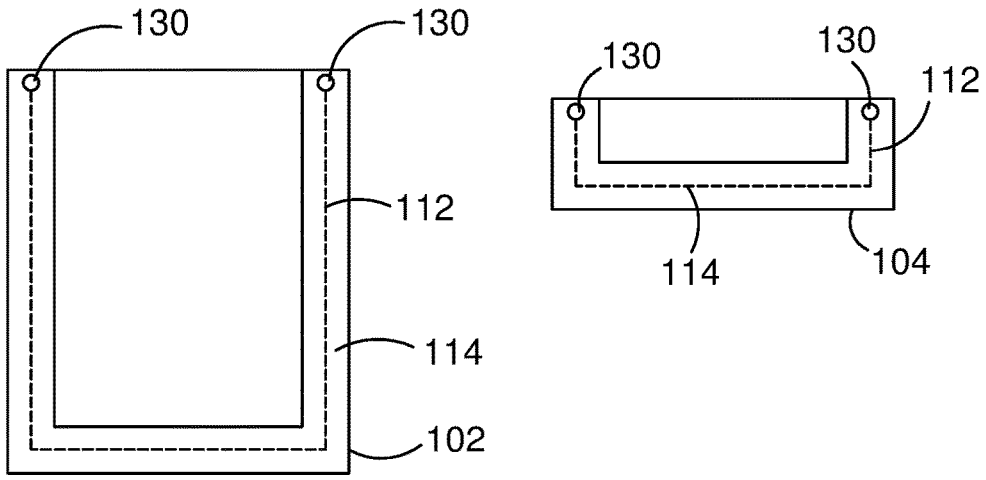
FIG. 7 is a sectional side view of the container and lid.
Figure 8:
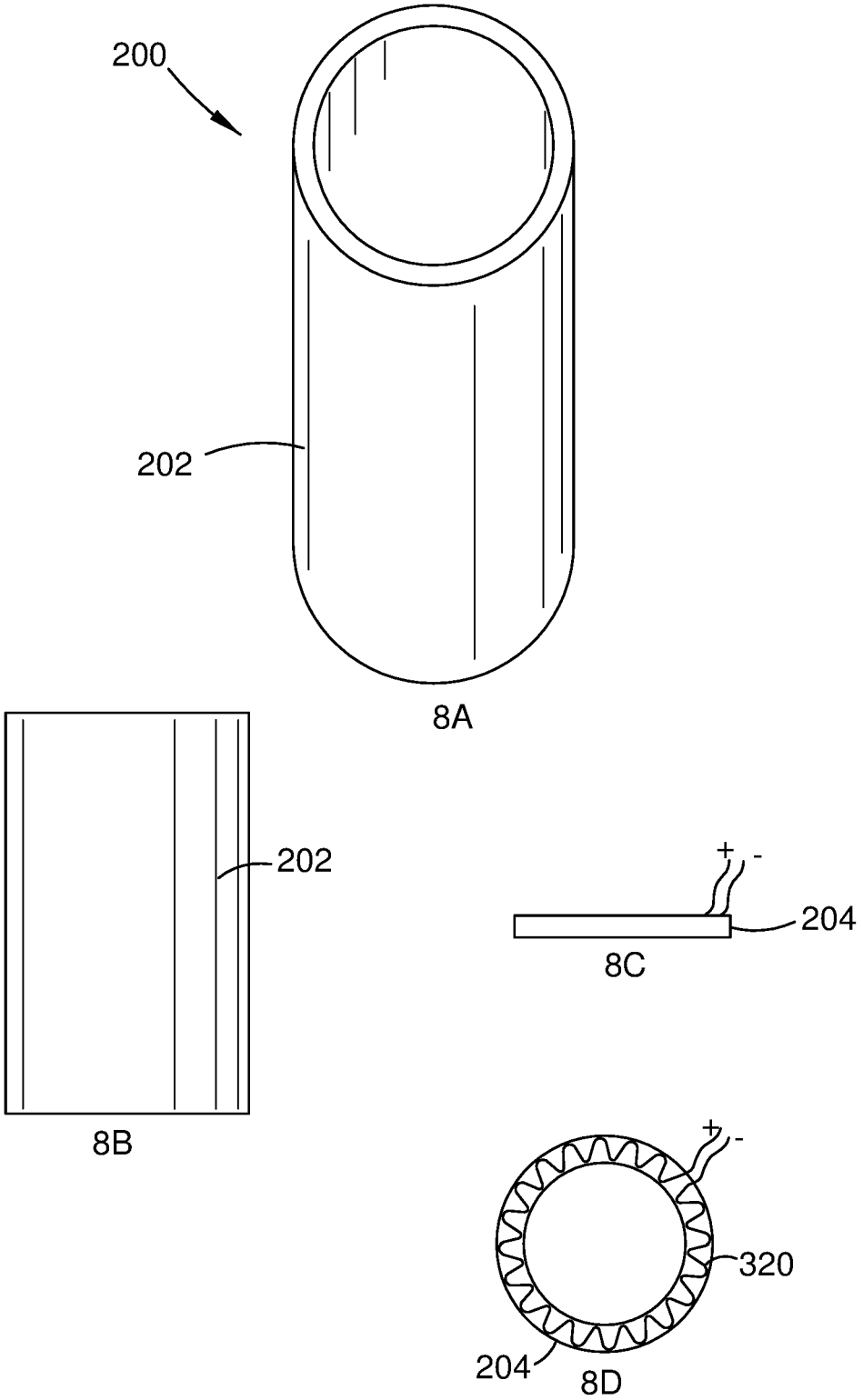
FIGS. 8*a* to 8*d* are views of a container of another embodiment of the invention.

In one form, the container 100 is sealed by heating edges of adjacent panels and bringing them together. In one example, the panels 10 forming the container 100 may have at least one heating element disposed near an exposed edge and operable for heating the edge of panels to fuse adjacent panels together. The at least one heating element may be integrally formed within the panel. An example of heating elements 130 are shown in FIG. 7 in relation to container 100 for the purposes of fusing the lower housing 102 and the lid 104 together.

In the illustrated embodiment, the heating elements 130 are formed within each member near an edge to be joined. Although illustrated as having a heating member 130 at each edge, it will be appreciated that it may be possible to have only a single heating member at either edge. In a preferred form, the heating member 130 is a conductive resistance element that is configured to heat up when an electrical current is applied to it, thereby heating the matrix material 114 to fuse the housing 102 and the lid 104 together.

The lower housing 102 (and also possibly the lid 104) may also be provided with corner protection members 132 fixed to an external surface of the housing/lid for additional protection from impact and/or wear during transportation.

As discussed above, by forming the container 100 in the described manner, it may be formed using moulding processes or formed of panels formed using moulding processes, thereby providing significant freedom as to the final external shape of the container 100. Preferably, the container 100 is rectangular so that it can be efficiently stacked in a space for storage and/or transportation, though it may also be cylindrical. Also, the containers may be sized so as to closely fit within the transportation container without freedom for movement so that they are not required to be strapped in position. The container 100 preferably has sufficient strength so as to allow like containers to be stacked 10 to 15 deep, compared with previously proposed containers which can only be stacked 3 to 5 deep.

The container 100 may be provided with a lockable lid and a vent to vent gases to the atmosphere, both of which may be recessed so as to not reduce stackability. The container 100 may also be provided with recesses along a lower edge for receipt of forklift tines to allow loading by forklift.

It will be appreciated that the described panels 10 will have many uses in connection with the encapsulation, containment, storage and transportation of radioactive and hazardous/toxic waste. In one example, the panels 10 may be used in a large liquid storage facility, such as a tailings dam for example. In such an embodiment, reinforcement members of the panels 10 may be interconnected so that the tensile strength of the reinforcement members can be utilised and tension forces transferred across a plurality of panels forming the facility. In such an embodiment, the panels 10 may be interconnected and laid over a base surface of the dam and additional encapsulation composition, wax or LDPE applied to gaps to completely seal the base of the dam. Those skilled in the art will appreciate that using the panels 10 in this way will provide a well sealed dam that can effectively store radioactive, hazardous or toxic waste, while providing sufficient flexibility to accommodate seismic activity.

In another example, the described panels 10 and container 100 may form part of a transportation system including a plurality of panels 10 and a plurality of containers 100. The panels 10 may be arranged within and line a transportation container, such as a truck trailer or conventional shipping container for example, within which the plurality of containers 100 are disposed. The panels 10 are preferably configured so as to be interconnected to effectively seal the transportation container. In one form, the panels 10 may be provided with magnetic elements formed within the panel to allow them to be removably installed within the container, thereby providing an additional shield during installation if required.

Through use of panels 10 in this manner, contamination of the transportation container may be avoided. Also, the exposure of people handling the waste or coming into proximity with the container may be reduced or avoided, making the transportation of the toxic material safer.

A method of encapsulating toxic materials is also provided herein. In one form, the method includes the step of inserting toxic material into a container of the above described type. In another form, the method includes the steps of bringing to a molten form a composition including a non-biodegradable thermoplastic polymer and a wax or fat, combining the toxic material with the composition to form an admixture; and pouring the admixture into a container 100 of the above described type. In one form the composition is 100% wax, which allows efficient recycling of the waste. In another form, the composition can be 100% polyolefin. In other forms, the composition is a mixture of wax and polyolefin and such composition can be in accordance with the above described matrix material. Advantageously, adhesion between the admixture and the container will occur, further acting to safely contain the waste within the container.

In alternative embodiments, the waste may be bagged, using either paper or plastic, or otherwise collected prior to being placed in the container.

In use, the admixture may be compressed within the container to reduce the volume of the toxic material. This may be required in applications where the toxic material is mixed, such as is hospital waste for example, where disposable items such as gloves and containers may be intermixed in the toxic material. Once filled to a predetermined level, the admixture may be covered with a further amount of the molten composition to further seal the container and ensure adequate encapsulation.

Once filled, the method can include the step of applying a lid to the container and sealing the container. The lid may be in accordance with lid 104 or formed of a panel 10 of the above described type.

In a preferred form, the admixture is combined in an auger. In this regard, the composition may stored in a hopper before being melted and introduced to the auger. Subsequently, the toxic material may be introduced into the auger for combination with the molten composition. Using the above described composition, the viscosity of the composition is lower than previous compositions, thereby allowing mixing within the auger to be performed with reduced energy and reduced load on the auger. Furthermore, the higher viscosity of the composition also leads to better coating and encapsulation of the waste so that it is completely surrounded and encapsulated within the composition.

Those skilled in the art will appreciate that the toxic material may take many forms such as radioactive/nuclear waste, medical waste from hospitals, waste from energy production, mining or manufacturing processes.

In another form, the toxic material is extracted from a vapour distillation process. Such a process is disclosed in other applications to the present applicant, such as International Patent Application no. PCT/AU2015/050382, the entire contents of which are incorporated by reference herein.

The vapour distillation process described in PCT/AU2015/050382 may be used to evaporate water from a contaminated source, such as a tailings dam used for disposal of hazardous waste from mining operations. Through use of such a distillation process, purified water can be obtained along with concentrated sludge containing the toxic material/hazardous waste. The purifies water can be returned to the contaminated water source for collection of further waste. Also, the concentrated waste can be mined in a second mining operation to remove trace elements that may be commercially valuable before the final concentrated product is encapsulated in a container 100 for storage or transportation to a storage site.

Waste water from fracking operations may also be treated in this way to remove chemicals from the water for collection and return purified water to a contaminated water source.

Advantageously, the environmental impact of contaminated water sources may be reduced and the toxic/hazardous constituents removed for safe storage in another location.

The present invention provides many advantages over previously proposed toxic waste disposal systems. In addition to providing superior performance and longevity over previous systems, storage may be performed cheaper and more efficiently. Also, as known materials that have undergone suitability testing for use with toxic substances are used in the different embodiments of the invention, it is envisaged that approval testing will be forthcoming without repetition of extensive material tests.

Furthermore, owing to the composition of the matrix material, it can be melted so that the toxic materials can be extracted and potentially recycled or reused. In one example, upper and lower portions of the container may be removed and acid allowed to seep through the encapsulated material to extract chemicals. Although such a process may take considerable time, having regard to the large amount of time over which the toxic waste is required to be stored, it relatively short. Circulation of the acid may be powered by solar energy so that power to a storage facility is not required. In such an embodiment, the container may be relatively large and of a similar size to a large room sealed from the environment with the exception of two pipes, one for bringing acid into the container, which is preferably distributed over the waste via a shower or sprinkler arrangement. The acid will react or dissolve selected metal and by gravity move it lower within the waste pile. A second pipe may be provided to remove the liquid to allow metals contained within the liquid to be separated, thereby allowing radiating isotopes to be removed and reuse or recycling and the liquid acid returned to the top of the waste pile to be distributed again.

In addition to allowing useful materials to be extracted from the waste, such a process can also reduce the size of the waste so that it may be consolidated over time into smaller containers to reduce the volume of material required to be stored at a site.

It will be appreciated that the described panel and container may be formed to any size or shape required to suit a particular application. FIGS. 8A to 8D illustrate another container 200 according to a further embodiment of the invention. The container 200 is in the form of a cylindrical drum and includes a lower portion or drum 202 and an upper portion or lid 204. The container 200 is configured so as to be a direct alternative to conventional steel drums currently used for encapsulating toxic materials and is preferably configured for the disposal or transportation of medical waste. Advantageously, container 200 is not vulnerable to corrosion (both internal and external) like a steel drum and virtually any waste can be handled.

The container 200 includes a heating element 230 formed within the lid 204 and disposed near an edge to be joined with the drum 202. A similar heating element may also be provided at an upper portion of the drum 202. In a preferred form, the heating member 230 is a conductive resistance element that is configured to heat up when an electrical current is applied to it, thereby heating the material to fuse the drum 202 and the lid 204 together to seal the drum once filled. In one form, the heating element may be configured to be operable under mains power and a simple power cord provided for activation.

Figure 9:
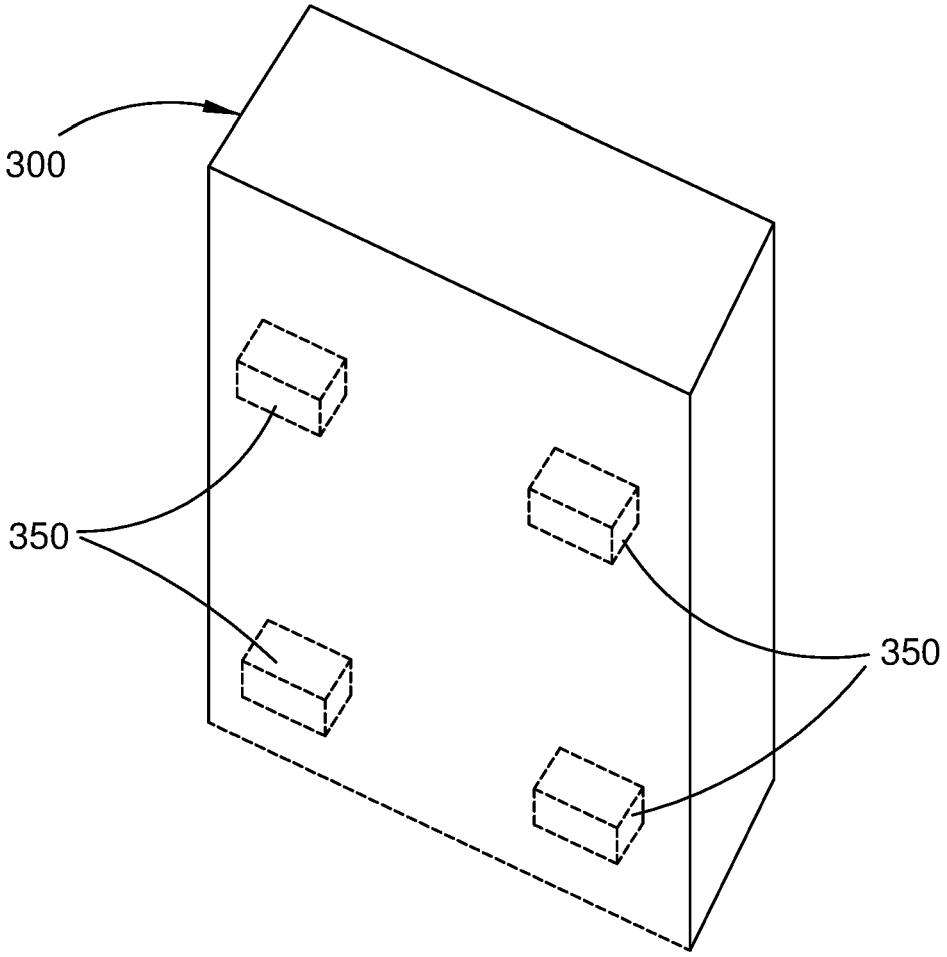
FIG. 9 is a perspective view of a panel of another embodiment of the invention.

FIG. 9 illustrates a panel 300 according to another embodiment of the invention. The panel 300 is also configured for use in a toxic material encapsulation system and is formed of a composition including a non-biodegradable thermoplastic polymer such as polyolefin and a wax or fat. The panel 300 is preferably formed of HDPE or LDPE. An internal reinforcing structure (not shown) may also be provided, in accordance with previously described embodiments. The panel 300 is also formed with magnets 350 disposed within the panel 300 to allow the panel to be easily fixed to metallic walls, such as those of a shipping container.

The panel 300 may be a hollow body which can be filled with boron, graphite or carbon suspended in water, wax or fat, to increase the radiation shielding properties of the panel. A further radiation shield may also be provided if required. Prior to use, the hollow body of the panel 300 is closed with a lid and sealed to prevent escape of liquid.

Figure 10:
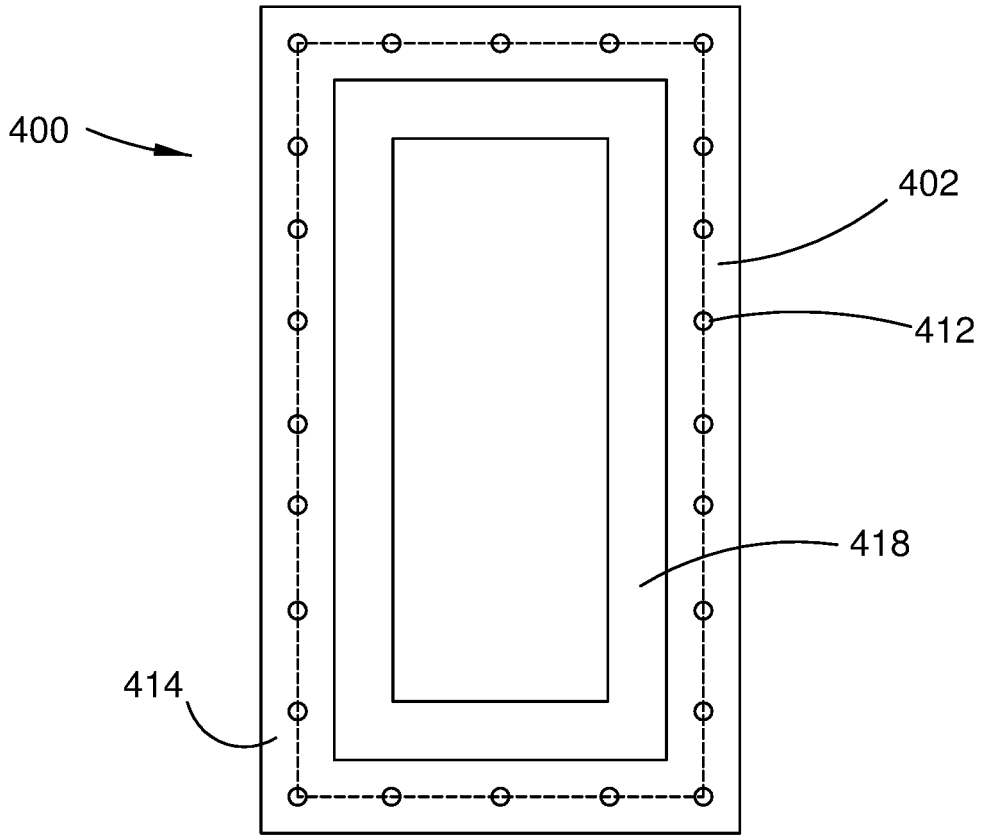
FIG. 10 is a sectional view of a container of one embodiment of the invention.

FIG. 10 illustrates a container 400 is also configured for use in a toxic material encapsulation system. The container 400 comprises a reinforcing structure 412 at least partially disposed within a matrix material 414. The matrix material 414 is a composition including a non-biodegradable thermoplastic polymer such as polyolefin and a wax or fat. The container 400 also includes a radiation shield 418 which is shown as a layer formed within the container. The radiation shield 418 is in the form of a further layer of the above described composition, i.e. a composition including a non-biodegradable thermoplastic polymer and a wax or fat. The thickness of the shield 418 may be tailored to the application.

The invention is further illustrated in the following examples. The examples are for the purpose of describing particular embodiments only and are not intended to be limiting with respect to the above description.

Example 1

Preparation of Encapsulation Compositions

According to the first embodiment, the encapsulation composition includes a non-biodegradable thermoplastic polymer and a wax. As indicated above, the polymer is present in the composition in an amount from about 0.5% to about 30% by total volume of the composition, and the wax is present in an amount from about 10% to about 99.5% by total volume. To determine the optimal amount of these constituents to include in the composition, in terms of minimising leaching of the waste from the composition, various formulations can be prepared and tested according to standard methodologies. Representative formulations are provided in Table 1.

TABLE 1

| Formulation | Polymer (% wt) | Wax (% wt) |
|---|---|---|
| 1 | 0.5 | 99.5 |
| 2 | 5 | 95 |
| 3 | 10 | 90 |
| 4 | 15 | 85 |
| 5 | 20 | 80 |
| 6 | 25 | 75 |
| 7 | 30 | 70 |

In variations of the first embodiment, the encapsulation composition also includes an anhydrous, anti-leaching agent. As indicated above, the agent may be present in the composition in an amount from about 5% to about 60% by total volume of the composition. In this regard, the formulations provided in Table 2 can be prepared in determining the optimal amount of constituents to include in the composition, in terms of minimising leaching of the waste from the composition.

TABLE 2

| Formulation | Polymer (% wt) | Wax (% wt) | Agent (% wt) |
|---|---|---|---|
| 1 | 0.5 | 94.5 | 5 |
| 2 | 5 | 85 | 10 |
| 3 | 10 | 75 | 15 |
| 4 | 15 | 65 | 20 |
| 5 | 20 | 55 | 25 |
| 6 | 25 | 45 | 30 |
| 7 | 30 | 35 | 35 |
| 8 | 5 | 35 | 60 |

According to the second embodiment, the encapsulation composition includes a non-biodegradable thermoplastic polymer; a wax; and waste, including radioactive and/or hazardous waste. In some embodiments, the waste is in a dry or near-dry form in which case the waste may be present in the composition in an amount from about 10% to about 85% by weight of the composition. In this regard, the formulations provided in Table 3 can be prepared in determining the optimal amount of constituents to include in the composition, in terms of minimising leaching of the waste from the composition whilst maximising the amount of waste encapsulated.

TABLE 3

| Formulation | Polymer (% wt) | Wax (% wt) | Waste (% wt) |
|---|---|---|---|
| 1 | 10 | 80 | 10 |
| 2 | 5 | 55 | 40 |
| 3 | 10 | 50 | 40 |
| 4 | 5 | 45 | 50 |
| 5 | 10 | 40 | 50 |
| 6 | 15 | 35 | 50 |
| 7 | 5 | 35 | 60 |
| 8 | 10 | 30 | 60 |
| 9 | 5 | 25 | 70 |
| 10 | 5 | 10 | 85 |

In variations of the second embodiment, the encapsulation composition also includes an anhydrous, anti-leaching agent. Therefore, the formulations provided in Table 4 can be prepared in determining the optimal amount of constituents to include in the composition, in terms of minimising leaching of the waste from the composition whilst maximising the amount of waste encapsulated.

TABLE 4

| Formulation | Polymer (% wt) | Wax (% wt) | Agent (% wt) | Waste (% wt) |
|---|---|---|---|---|
| 1 | 25 | 60 | 5 | 10 |
| 2 | 10 | 40 | 10 | 40 |
| 3 | 20 | 30 | 10 | 40 |
| 4 | 5 | 35 | 10 | 50 |
| 5 | 10 | 35 | 5 | 50 |
| 6 | 10 | 30 | 10 | 50 |
| 7 | 5 | 30 | 5 | 60 |
| 8 | 10 | 25 | 5 | 60 |
| 9 | 5 | 20 | 5 | 70 |
| 10 | 5 | 10 | 5 | 80 |

Example 2

Performance Testing of the Encapsulation Compositions

Encapsulation of contaminants within a waste form is the first of a number of barriers that may be employed to isolate and contain the waste from leaching into the environment. The durability of such encapsulated waste over extended periods of time and in various environmental conditions therefore plays an important role in ensuring that the contaminants in the encapsulated waste remain isolated and contained. Accordingly, it is important to test the encapsulation compositions to ensure that they are structurally stable, and therefore sufficiently retain the waste encapsulated therein, over time. In this regard, appropriate tests will involve the application of short-term conditioning and property evaluations that reflect as accurately as possible the anticipated conditions of disposal, storage and containment of the waste. The following tests may be applied to waste encapsulated by the compositions. The tests are standardised techniques recognised by relevant regulatory authorities such as the American Society for Testing and Materials (ASTM) International, the International Organisation for Standardisation (ISO), and the Environmental Protection Authority/Agency (EPA) on a jurisdictional basis.

Flammability Testing

The described encapsulation compositions (with waste encapsulated therein) can be subject to a flammability assessment according to a number of testing modalities. These include, but are not limited to the following.

Cone calorimeter (ISO 5660/ASTM E-1354)—this test is comprehensive in that it provides data on most of the fundamental combustion characteristics of a sample material under evaluation (e.g. ease of ignition, rate of heat release, weight of sample as it burns, temperature of sample as it burns, rate of weight loss, rate of smoke release, and yield of smoke) under a wide range of heater and ignition conditions. As a result of the vast amount of data available from this test, a model of the combustion of the sample material might be developed, thus enabling an estimation of the potential effects of a fire on surrounding areas and occupants.

Ignition test (ISO 871-1996/ASTM D-1929)—this test is used to measure and describe the response of a sample material under evaluation to heat and flame under controlled conditions. However, the test does not by itself incorporate all factors required for fire-hazard or fire-risk assessment of the material under actual fire conditions.

Radiant Panel Test (ASTM E-162)—this test measures and compares the surface flammability of sample material under evaluation when exposed to a prescribed level of radiant heat energy. It is intended for use in measurements of the surface flammability of the sample materials when exposed to fire.

Limiting Oxygen Index, LOI (ISO 4589-2/ASTM 0-2863)—in this test, a sample material under evaluation is suspended vertically inside a closed chamber (usually a glass or clear plastic enclosure). The chamber is equipped with oxygen and nitrogen gas inlets so that the atmosphere in the chamber can be controlled. The sample material is ignited from the bottom and the atmosphere is adjusted to determine the minimum amount of oxygen to just sustain burning. This minimum oxygen content, expressed as a percentage of the oxygen/nitrogen atmosphere, is called the oxygen index. Higher numbers are associated with decreased flammability.

Compressive Strength Testing

Compression tests will provide information about the compressive properties of the sample material under evaluation when employed under conditions approximating those under which the tests are made. Compressive properties include modulus of elasticity, yield stress, deformation beyond yield point, and compressive strength (unless the sample material merely flattens but does not fracture). Sample materials possessing a low order of ductility may not exhibit a yield point. In the case of a sample material that fails in compression by a shattering fracture, the compressive strength has a very definite value. In the case of a sample material that does not fail in compression by a shattering fracture, the compressive strength is an arbitrary one depending upon the degree of distortion that is regarded as indicating complete failure of the sample material. Representative tests include the ASTM Standard Test Method for Compressive Properties of Rigid Plastics—ASTM 0695 (technically equivalent to ISO 604).

Leachability Tests

These tests are designed to analyse the effectiveness with which the encapsulation composition can retain or reduce the leaking or leaching from the composition of marker contaminants present within the encapsulated waste. The marker contaminants can be artificially loaded into the waste for measurement purposes. Such marker contaminants typically include various metals such as lead, silver, nickel, mercury, chromium, arsenic, cadmium, beryllium, and barium.

The most common leachability test employed is the Toxicity Characteristics Leaching Procedure (TCLP) as provided by the US EPA (Method 1311). In the TCLP procedure the sample material is leached in one of two buffer solutions. A first buffer solution (pH 4.93) is used for neutral to acidic materials whilst a second buffer solution (pH 2.88) is used for alkaline wastes. The leachate mixture is sealed in extraction vessel and tumbled for 18 hours to simulate an extended leaching time in the ground. It is then filtered so that only the solution (not the sample) remains and this is then analysed, for example by inductively coupled plasma spectroscopy.

Alternatives to the TCLP are available. These include the ASTM 03987-85 Shake Extraction of Solid Waste with Water, and the Standards Australia Bottle Leaching Procedure (AS 4439-1997). The ASTM 03987-85 procedure provides a half-way point between acidic TCLP conditions and in situ conditions by allowing a leach in deionised water. The AS 4439-1997 procedure differs from the TCLP in two main ways—(1) maximum sample particle size for AS 4439 is 2.4 mm in contrast to the TCLP that allows 9.5 mm; and (2) in addition to the standard TCLP buffers, AS 4439 allows the use of three alternate buffers depending on the application, namely (i) reagent water (applicable when a waste is undisturbed and left on site); (ii) tetraborate pH 9.2 (for acid volatile target analytes); and (iii) local water (when exposure to local ground, surface or sea water is expected).

As would be understood by a person skilled in the art, other rigorous testing regimes may be employed to test the effectiveness of the encapsulation composition to retain the waste encapsulated therein. These include crash or drop tests, or more extreme "gorilla" or "torture" tests.

Example 3

Performance Testing of the Encapsulation and Containment System

According to a fourth embodiment, there is provided a system for the encapsulation and containment of radioactive and/or hazardous waste. In one embodiment, the system includes: (i) an encapsulation composition for the encapsulation of the radioactive and/or hazardous waste, the encapsulation composition including a non-biodegradable thermoplastic polymer, and a wax; and (ii) a container for receiving the encapsulation composition.

Whilst the tests referred to in Example 2 evaluate the effectiveness of the encapsulation composition to retain waste encapsulated therein, testing of the ability of the container to maintain containment of the encapsulated waste under stress or duress can be employed. With respect to radioactive waste, tests may also be employed to identify the level of radioactivity being emitted through the container. Such tests are conducted according to relevant national and international standards as required by various regulatory bodies such as the International Atomic Energy Agency, and the Environmental Protection Authority/Agency (EPA) on a jurisdictional basis. Such tests would include crash or drop tests, or more extreme "gorilla" or "torture" tests.

It is to be noted that where a range of values is expressed, it will be clearly understood that this range encompasses the upper and lower limits of the range, and all values in between these limits. Furthermore, the term "about" as used in the specification means approximately or nearly and in the context of a numerical value or range set forth herein is meant to encompass variations of +/−10% or less, +/−5% or less, +/−1% or less, or +/−0.1% or less of and from the numerical value or range recited or claimed.

It will be apparent to the person skilled in the art that while the invention has been described in some detail for the purposes of clarity and understanding, various modifications and alterations to the embodiments and methods described herein may be made without departing from the scope of the inventive concept disclosed in this specification.

The invention claimed is:

1. A container for encapsulating radioactive and/or hazardous/toxic waste materials, the container comprising a housing formed by or including a plurality of composite panels, each panel comprising a reinforcing structure at least partially disposed within a matrix material, the matrix material being a composition including a non-biodegradable thermoplastic polymer and a wax or fat, with the container being sealed and containing a monolithic solid having a shape that conforms with the housing and comprising a homogenous mixture of radioactive and/or hazardous/toxic waste encapsulated within an encapsulating composition comprising non-biodegradable thermoplastic polymer and wax, wherein the panels of the housing are configured to bond to the monolithic solid located therein, and wherein the encapsulating composition is melt mixed with the radioactive and/or hazardous/toxic waste such that the encapsulating composition and the waste are mechanically mixed while the encapsulating composition is in a molten state, thereby encapsulating the waste in the composition.

2. A container according to claim 1, further including an internal radiation shield formed within the container, the shield being formed of a composition including boron or graphite, or combinations thereof, and fat.

3. A container according to claim 1, wherein the container is of unitary construction.

4. A container according to claim 1, wherein the container is an open top container, and further comprises a sealing lid adapted to seal the container top by melting the matrix material.

5. A container according to claim 1, wherein the container has at least one electrically conductive heating element disposed near an open end of the container and energisable for heating the matrix material to fuse a lid to the container.

6. A container according to claim 5, wherein the at least one heating element is integrally formed within the panel.

7. A container according to claim 1, further comprising a gas discharge vent.

8. A container according to claim 1, further comprising corner protection members.

9. A container according to claim 1, further including recesses formed in a lower portion thereof for engagement with a lifting vehicle.

10. A container according to claim 1, wherein lower and upper surfaces of the container include complimentary shaped interlocking features to enable interlocking stacking of a plurality of containers.

11. A container according to claim 1, wherein the non-biodegradable thermoplastic polymer of the matrix material and/or the encapsulating composition is a polyolefin selected from the group consisting of low density polyethylene (LDPE), polypropylene, high density polyethylene (HDPE), acrylic, polyvinyl ethylene, polyvinyl acetate, polyvinyl chloride (PVC), polystyrene, nylon, polybutadiene, and mixtures thereof.

12. A container according to claim 1, wherein the wax of the matrix material and/or the encapsulating composition is selected from one or more of the group consisting of paraffin, beeswax, Chinese wax, lanolin, shellac wax, spermaceti, bayberry wax, candelilla wax, carnauba wax, insect wax, castor wax, esparto wax, Japan wax, jojoba oil, ouricury wax, rice bran wax, soy wax, lotus wax, ceresin wax, montan wax, ozocerite, peat waxes, microcrystalline wax, petroleum jelly, Fischer-Tropsch waxes, substituted amide waxes, cetyl palmitate, lauryl palmitate, cetostearyl stearate, polyethylene wax, C3o-45 Alkyl Methicone and C3o-45 Olefin.

13. A container according to claim 1, the matrix material further including a filler or reinforcing fibre selected from one or more of the group consisting of dry clean or waste wood powder, glass fibre, carbon fibre, aramide fibre, silicon carbide fibre, boron fibre, alumina fibre, aromatic polyamide fibre, high elastic polyester fibre, hemp, jute or sisal.

14. A container according to claim 1, wherein the panels of the housing and the monolithic solid are formed of similar compositions to thereby enable the monolithic solid to bond to the housing.

15. A container for encapsulating toxic waste material, the container comprising:

a housing having a reinforcing structure that is at least partially disposed within a matrix material, the matrix material including a non-biodegradable thermoplastic polymer and a wax or fat; and a monolithic solid that is sealed within the housing, the monolithic solid having a shape that conforms with the housing and comprising a homogenous mixture of toxic waste material that is encapsulated within an encapsulation composition that includes a non-biodegradable thermoplastic polymer and a wax;

wherein the housing is configured to bond to the monolithic solid located therein.

16. A container according to claim 15, wherein the housing and the monolithic solid are formed of similar compositions to thereby enable the monolithic solid to bond to the housing.

* * * * *